US011742575B2

(12) United States Patent
Thomas et al.

(10) Patent No.: US 11,742,575 B2
(45) Date of Patent: Aug. 29, 2023

(54) REMOTE ELECTRONIC TILT BASE STATION ANTENNAS HAVING ADJUSTABLE RET LINKAGES

(71) Applicant: CommScope Technologies LLC, Hickory, NC (US)

(72) Inventors: Sean Gregory Thomas, McKinney, TX (US); Chongli Yang, Jiangsu (CN); Guomin Ding, Jiangsu (CN); Junfeng Yu, Jiangsu (CN); Zhaohui Liu, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 18/045,559

(22) Filed: Oct. 11, 2022

(65) Prior Publication Data

US 2023/0053624 A1 Feb. 23, 2023

Related U.S. Application Data

(63) Continuation of application No. 17/252,332, filed as application No. PCT/US2019/039377 on Jun. 27, 2019, now Pat. No. 11,502,407.

(60) Provisional application No. 62/696,996, filed on Jul. 12, 2018.

(51) Int. Cl.

| | |
|---|---|
| ***H01Q 3/32*** | (2006.01) |
| ***H01P 1/18*** | (2006.01) |
| ***H01Q 5/48*** | (2015.01) |
| ***H01Q 1/24*** | (2006.01) |

(Continued)

(52) U.S. Cl.
CPC ..... *H01Q 3/32* (2013.01); *H01Q 1/246* (2013.01); *H01Q 5/48* (2015.01); *H01Q 9/285* (2013.01); *H01Q 25/001* (2013.01)

(58) Field of Classification Search
CPC ..... H01Q 1/246; H01Q 25/00; H01Q 25/001; H01Q 1/12; H01Q 1/1264; H01Q 3/00; H01Q 3/005; H01Q 3/02; H01Q 3/04; H01Q 3/08; H01Q 3/30; H01Q 3/32; H01Q 3/36; H01Q 5/48; H01Q 9/28; H01Q 9/285; H01P 1/18
See application file for complete search history.

(56) References Cited

U.S. PATENT DOCUMENTS

| | | |
|---|---|---|
| 5,440,318 A | 8/1995 | Butland et al. |
| 7,274,331 B2 | 9/2007 | Heiniger et al. |

(Continued)

OTHER PUBLICATIONS

International Search Report and the Written Opinion of the International Searching Authority corresponding to International Patent Application No. PCT/US2019/039377 (9 pages) (dated Oct. 2, 2019).

*Primary Examiner* — Tho G Phan
(74) *Attorney, Agent, or Firm* — Myers Bigel, P.A.

(57) ABSTRACT

A base station antenna includes a remote electronic tilt ("RET") actuator, a phase shifter having a moveable element and a mechanical linkage extending between the RET actuator and the phase shifter. The mechanical linkage includes an adjustable RET linkage that has a first link that has a first connection element, a second link that has a second connection element and a connecting member that includes at least a third link. The adjustable RET linkage includes at least a first hinge and a second hinge.

20 Claims, 23 Drawing Sheets

(51) Int. Cl.
*H01Q 9/28* (2006.01)
*H01Q 25/00* (2006.01)

(56) References Cited

U.S. PATENT DOCUMENTS

| | | | | |
|---|---|---|---|---|
| 8,217,848 | B2 * | 7/2012 | Girard | H01Q 1/246 343/765 |
| 8,638,264 | B2 | 1/2014 | Hall | |
| 10,411,347 | B2 | 9/2019 | Liao et al. | |
| 10,615,488 | B2 * | 4/2020 | Liu | H01Q 1/246 |
| 10,854,967 | B2 * | 12/2020 | Zimmerman | H01Q 1/246 |
| 11,304,069 | B2 | 4/2022 | Zimmerman et al. | |
| 11,355,830 | B2 * | 6/2022 | Ding | H01Q 1/1264 |
| 11,374,316 | B2 * | 6/2022 | Xu | B60N 2/0232 |
| 11,387,553 | B2 * | 7/2022 | Shao | H01Q 1/246 |
| 11,552,396 | B2 * | 1/2023 | Wang | H01Q 3/32 |
| 11,600,920 | B2 * | 3/2023 | Udagave | H01Q 3/36 |
| 2016/0013532 | A1 | 1/2016 | Iso et al. | |
| 2016/0134007 | A1 | 5/2016 | Ding et al. | |
| 2016/0352011 | A1 | 12/2016 | Duan | |
| 2018/0026366 | A1 | 1/2018 | Xu et al. | |
| 2020/0373663 | A1 | 11/2020 | Xu | |

* cited by examiner

REMOTE ELECTRONIC TILT BASE STATION ANTENNAS HAVING ADJUSTABLE RET LINKAGES

CROSS-REFERENCE TO RELATED APPLICATIONS

This application is a continuation application of U.S. patent application Ser. No. 17/252,332, filed Dec. 15, 2020, which is a 35 USC § 371 US national stage application of PCT/US2019/039377, filed Jun. 27, 2019, which claims the benefit of and priority to U.S. Provisional Application Ser. No. 62/696,996, filed Jul. 12, 2018, the entire contents of each of which are incorporated herein by reference as if set forth fully herein.

FIELD OF THE INVENTION

The present invention relates to communication systems and, in particular, to base station antennas having remote electronic tilt capabilities.

BACKGROUND

Cellular communications systems are used to provide wireless communications to fixed and mobile subscribers. A cellular communications system may include a plurality of base stations that each provide wireless cellular service for a specified coverage area that is typically referred to as a "cell." Each base station may include one or more base station antennas that are used to transmit radio frequency ("RF") signals to, and receive RF signals from, the subscribers that are within the cell served by the base station. Base station antennas are directional devices that can concentrate the RF energy that is transmitted in or received from certain directions. The "gain" of a base station antenna in a given direction is a measure of the ability of the antenna to concentrate the RF energy in that direction. The "radiation pattern" of a base station antenna—which is also referred to as an "antenna beam"—is a compilation of the gain of the antenna across all different directions. Each antenna beam may be designed to service a pre-defined coverage area such as the cell or a portion thereof that is referred to as a "sector." Each antenna beam may be designed to have minimum gain levels throughout the pre-defined coverage area, and to have much lower gain levels outside of the coverage area to reduce interference between neighboring cells/sectors. Base station antennas typically comprise a linear array of radiating elements such as patch, dipole or crossed dipole radiating elements. Many base station antennas now include multiple linear arrays of radiating elements, each of which generates its own antenna beam.

Early base station antennas generated antenna beams having fixed shapes, meaning that once a base station antenna was installed, its antenna beam(s) could not be changed unless a technician physically reconfigured the antenna. Many modern base station antennas now have antenna beams that can be electronically reconfigured from a remote location. The most common way in which an antenna beam may be reconfigured electronically is to change the pointing direction of the antenna beam (i.e., the direction in which the antenna beam has the highest gain), which is referred to as electronically "steering" the antenna beam. An antenna beam may be steered horizontally in the azimuth plane and/or vertically in the elevation plane. An antenna beam can be electronically steered by transmitting control signals to the antenna that cause the antenna to alter the phases of the sub-components of the RF signals that are transmitted and received by the individual radiating elements of the linear array that generates the antenna beam. Most modern base station antennas are configured so that the elevation or "tilt" angle of the antenna beams generated by the antenna can be electronically altered. Such antennas are commonly referred to as remote electronic tilt ("RET") antennas.

In order to electronically change the down tilt angle of an antenna beam generated by a linear array of radiating elements, a phase taper may be applied across the radiating elements of the array. Such a phase taper may be applied by adjusting the settings on a phase shifter that is positioned along the RF transmission path between a radio and the individual radiating elements of the linear array. One widely-used type of phase shifter is an electromechanical "wiper" phase shifter that includes a main printed circuit board and a "wiper" printed circuit board that may be rotated above the main printed circuit board. Such wiper phase shifters typically divide an input RF signal that is received at the main printed circuit board into a plurality of sub-components, and then couple at least some of these sub-components to the wiper printed circuit board. The sub-components of the RF signal may be coupled from the wiper printed circuit board back to the main printed circuit board along a plurality of arc-shaped traces, where each arc has a different diameter. Each end of each arc-shaped trace may be connected to a respective sub-group of radiating elements that includes at least one radiating element. By physically (mechanically) rotating the wiper printed circuit board above the main printed circuit board, the locations where the sub-components of the RF signal couple back to the main printed circuit board may be changed, which thus changes the lengths of the transmission paths from the phase shifter to the respective sub-groups of radiating elements. The changes in these path lengths result in changes in the phases of the respective sub-components of the RF signal, and since the arcs have different radii, the phase changes along the different paths will be different. Typically, the phase taper is applied by applying positive phase shifts of various magnitudes (e.g., +X°, +2X° and +3X°) to some of the sub-components of the RF signal and by applying negative phase shifts of the same magnitudes (e.g., −X°, −2X° and −3X°) to additional of the sub-components of the RF signal. Exemplary phase shifters of this variety are discussed in U.S. Pat. No. 7,907,096 to Timofeev, the disclosure of which is hereby incorporated herein in its entirety. The wiper printed circuit board is typically moved using an electromechanical actuator such as a DC motor that is connected to the wiper printed circuit board via a mechanical linkage. These actuators are often referred to as "RET actuators." Both individual RET actuators that drive a single mechanical linkage and "multi-RET actuators" that have a plurality of output members that drive a plurality or respective mechanical linkages are commonly used in base station antennas.

SUMMARY

Pursuant to embodiments of the present invention, base station antennas are provided that include a RET actuator, a phase shifter having a moveable element, and a mechanical linkage extending between the RET actuator and the phase shifter. The mechanical linkage includes an adjustable RET linkage that has a first link that has a first connection element, a second link that has a second connection element and a connecting member that includes at least a third link. The adjustable RET linkage includes at least a first hinge and a second hinge.

In some embodiments, the first hinge may connect the first link to the connecting member and/or the second hinge may connect the second link to the connecting member.

In some embodiments, the connection member may include the third link and a fourth link that is connected to the third link via a third hinge. In such embodiments, the first hinge may connect the first link to the third link and the second hinge may connect the second link to the fourth link. In some embodiments, the third link and the fourth link may have different sizes.

In some embodiments, the first connection element may be attached to a first RET rod of the mechanical linkage and the second connection element may be attached to a second RET rod of the mechanical linkage.

Pursuant to further embodiments of the present invention, base station antennas are provided that include a RET actuator, a phase shifter having a moveable element, and a mechanical linkage extending between the RET actuator and the phase shifter. The mechanical linkage includes a first RET rod, a second RET rod and an adjustable RET linkage that connects the first RET rod to the second RET rod. The adjustable RET linkage includes a first connection element that connects to the first RET rod and a second connection element that connects to the second RET rod. The adjustable RET linkage is configured so that a distance between the first connection element and the second connection element is adjustable.

In some embodiments, the adjustable RET linkage may include at least one hinge.

In some embodiments, the adjustable RET linkage may include a locking element.

In some embodiments, the adjustable RET linkage may be a multi-piece adjustable RET linkage that includes a first link and a second link that are configured to slide relative to one another.

In some embodiments, the adjustable RET linkage may be configured so that the distance between the first connection element and the second connection element is adjustable by at least 10 millimeters.

In some embodiments, the adjustable RET linkage may be a multi-piece adjustable RET linkage that includes a first link that is configured to attach to the first RET rod and a second link that is configured to attach to the second RET rod. In such embodiments, the adjustable RET linkage may include at least one additional link that is coupled between the first link and the second link. The first link may include a first annular receptacle and a second annular receptacle that is not collinear with the first annular receptacle.

In some embodiments, the adjustable RET linkage may include at least two hinges.

In some embodiments, the first connection element may be rotatable with respect to the second connection element.

In some embodiments, the adjustable RET linkage may be a multi-piece adjustable RET linkage that includes a first link and a second link that is configured to move relative to the first link.

In some embodiments, the adjustable RET linkage may be a multi-piece adjustable RET linkage that includes a first link that includes the first connection element, a second link that includes the second connection element, and third and fourth links that are connected between the first and second links. The third link and the fourth link may have different lengths in some embodiments.

In some embodiments, the first link may be connected to the third link by a first hinge, the third link may be connected to the fourth link by a second hinge, and the fourth link may be connected to the second link by a third hinge.

In some embodiments, the mechanical linkage may be configured to move the moveable element of the phase shifter in response to movement of the RET actuator.

In some embodiments, the adjustable RET linkage may comprise a multi-part RET linkage that includes a first piece that is mounted on the first RET rod, a second piece that is mounted on the second RET rod, and a third piece that connects the first piece to the second piece, wherein dimensions of the third piece are selected based at least in part on a distance between the first RET rod and the second RET rod in at least one of a width direction and a depth direction of the base station antenna. In some embodiments, the first and second pieces are plastic pieces and the third piece is a metal piece. For example, the third piece may be formed of stamped sheet metal. In some embodiments, the third piece may have mating features on opposed ends thereof that are configured to mate with corresponding mating features on the respective first and second pieces. In some embodiments, the third piece may be connected to the first piece by a snap-fit or snap-in connection.

Pursuant to further embodiments of the present invention, base station antennas are provided that include a RET actuator, a phase shifter having a moveable element, and a mechanical linkage extending between the RET actuator and the phase shifter. The mechanical linkage includes a first RET rod and an adjustable RET linkage that connects to the first RET rod, the adjustable RET linkage including a first link and a second link that is configured to move relative to the first link.

In some embodiments, the adjustable RET linkage may include at least one hinge.

In some embodiments, the adjustable RET linkage may include a locking element.

In some embodiments, the first link and the second link may be configured to slide relative to one another.

In some embodiments, the adjustable RET linkage may include a first connection element that connects to the first RET rod and a second connection element, and a distance between the first connection element and the second connection element may be adjustable.

In some embodiments, the first connection element may be rotatable with respect to the second connection element.

In some embodiments, the adjustable RET linkage may include at least one additional link that is coupled between the first link and the second link.

In some embodiments, the adjustable RET linkage may include at least two hinges.

In some embodiments, the adjustable RET linkage may further include a third link and a fourth link that are connected between the first and second links.

In some embodiments, the third link and the fourth link may have different lengths.

In some embodiments, the first link may be connected to the third link by a first hinge, the third link may be connected to the fourth link by a second hinge, and the fourth link may be connected to the second link by a third hinge.

In some embodiments, the mechanical linkage may be configured to move the moveable element of the phase shifter in response to movement of the RET actuator.

Pursuant to further embodiments of the present invention, base station antennas are provided that include a RET actuator, a phase shifter having a moveable element, and a mechanical linkage extending between the RET actuator and the phase shifter. The mechanical linkage includes a first RET rod, a second RET rod and an adjustable RET linkage that connects the first RET rod to the second RET rod. The adjustable RET linkage includes a first connection element that connects to the first RET rod and a second connection element that connects to the second RET rod. The first connection element is rotatable with respect to the second connection element.

In some embodiments, the adjustable RET linkage may include at least one hinge.

In some embodiments, the adjustable RET linkage may further include a locking element.

In some embodiments, the adjustable RET linkage may comprise a multi-piece adjustable RET linkage that includes a first link and a second link that are configured to slide relative to one another.

In some embodiments, the adjustable RET linkage may include at least three links and at least two hinges.

Pursuant to further embodiments of the present invention, base station antennas are provided that include a RET actuator, a phase shifter having a moveable element, and a mechanical linkage extending between the RET actuator and the phase shifter. The mechanical linkage includes a first RET rod, a second RET rod and a multi-piece RET linkage that includes a first piece that is mounted on the first RET rod, a second piece that is mounted on the second RET rod, and a third piece that is directly connected to the first piece. The dimensions of the third piece are selected based at least in part on a distance between the first RET rod and the second RET rod in at least one of a width direction and a depth direction of the base station antenna.

In some embodiments, the third piece may also be directly connected to the second piece, while in other embodiments the third piece may be indirectly connected to the second piece. In some embodiments, the first and second pieces may be plastic pieces and the third piece may be a sheet metal piece. In some embodiments, the third piece may have mating features on opposed ends thereof that are configured to mate with corresponding mating features on the respective first and second pieces via, for example, snap-fit or snap-in connect.

DETAILED DESCRIPTION

Figure 1A:
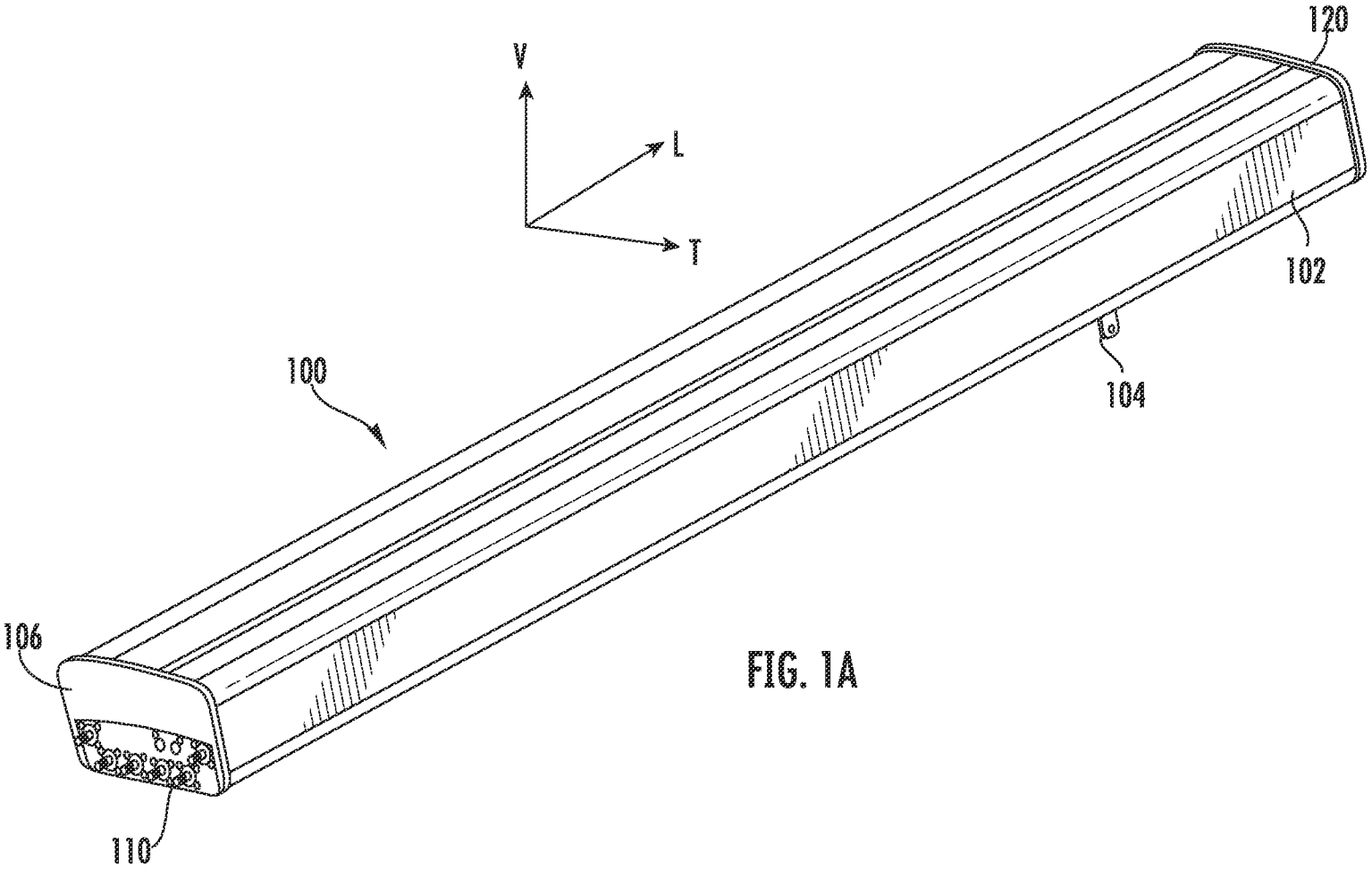
FIG. 1A is a perspective view of an example base station antenna according to embodiments of the present invention.

Modern base station antennas often include two, three or more linear arrays of radiating elements, where each linear array has an electronically adjustable down tilt. The linear arrays typically include cross-polarized radiating elements, and a separate phase shifter is provided for electronically adjusting the down tilt of the antenna beam for each polarization, so that the antenna may include twice as many phase shifters as linear arrays. Moreover, in many antennas, separate transmit and receive phase shifters are provided so that the transmit and receive radiation patterns may be independently adjusted. This again doubles the number of phase shifters. Thus, it is not uncommon for a base station antenna to have eight, twelve or more phase shifters for applying remote electronic down tilts to the linear arrays. As described above, RET actuators are provided in the antenna that are used to adjust the phase shifters. While the same downtilt is typically applied to the phase shifters for the two different polarizations, allowing a single RET actuator and a single mechanical linkage to be used to adjust the phase shifters for both polarizations, modern base station antennas still often include four, six or more RET actuators (or, alternatively, one or two multi-RET actuators) and associated mechanical linkages.

In order to change the downtilt angle of an antenna beam generated by a linear array on a base station antenna, a control signal may be transmitted to the antenna that causes a RET actuator associated with the linear array to generate a desired amount of movement in an output member thereof. The movement may comprise, for example, linear movement or rotational movement. A mechanical linkage is used to translate the movement of the output member of the RET actuator to movement of a moveable element of a phase shifter (e.g., a wiper arm) associated with the linear array. Accordingly, each mechanical linkage may extend between the output member of the RET actuator and the moveable element of the phase shifter.

Typically, a mechanical linkage may comprise a series of longitudinally-extending plastic or fiberglass RET rods that are connected by RET linkages that extend in the width and/or depth directions of the antenna. The RET linkages connect the RET rods to each other and/or to the RET actuator or the phase shifter. Multiple RET rods are often used because the output member of a RET actuator is often not aligned with the input member of an associated phase shifter in either or both the width or depth directions. Thus, for example, a RET linkage may be used to connect a first RET rod that is attached to the output member of a RET actuator to a second RET rod that is attached to the input member of a phase shifter in situations where the first and second RET rods are not aligned in either or both the width and depth directions. RET linkages may also or alternatively be used to connect a RET rod to the output member of a RET actuator and/or to an input member of a phase shifter. RET linkages can also be used to route a mechanical linkage around other components of the base station antenna that may be interposed along a direct path between the output member of the RET actuator and the input member of the associated phase shifter. The RET linkages may thus be used to form "jogs" in the mechanical linkage for either or both alignment and/or routing purposes. In many cases, three or even four RET rods may be included within a single mechanical linkage, thereby requiring multiple RET linkages for a single mechanical linkage. Moreover, the size and shape required for each RET linkage tends to vary. As such, a single base station antenna will typically require at least three or four (and often many more) different RET linkage designs, thereby increasing the parts count for the antenna.

Pursuant to embodiments of the present invention, base station antennas are provided that include mechanical linkages having adjustable RET linkages that can dramatically reduce the number of RET linkages that a particular base station antenna manufacturer need maintain in inventory. The adjustable RET linkages according to embodiments of the present invention may include a first link that is configured to connect to a first RET rod and a second link that is configured to connect to a second RET rod. The adjustable RET linkages may further include a connecting member that connects the first link to the second link. The connecting member may include one or more additional links.

In some embodiments, the adjustable RET linkages may include a first hinged connection between the first link and the connecting member and/or a second hinged connection between the second link and the connecting member. In addition, in some cases, the connecting member may include one or more hinged connections between distinct links thereof. These hinged connections may allow the adjustable RET linkage to span a range of different distances in the width and depth directions so that the same mechanical linkage may be used to connect elements that are spaced apart from each other by different distances or which are arranged with respect to each other at different orientations. As a result, a small number of different adjustable RET linkages may be used to connect RET rods that are spaced apart from each other at different distances and/or at different orientations. This may allow antenna manufacturers to hold fewer parts in inventory and may avoid the need to design and fabricate new RET linkages each time a new antenna is designed.

In other embodiments of the present invention, the adjustable RET linkage may include one or more sliding connections. In these embodiments, the first link may be connected to either the second link or to a connecting member by a sliding connection. The second link may also be connected to the connecting member by a sliding connection. Alternatively or additionally, the connecting member may include a sliding connection between two links thereof that allow a length of the connecting member (e.g., in the width direction) to be varied. The sliding connections may be set using locking mechanisms so that the adjustable RET linkage spans desired distances in the width and depth directions.

In additional embodiments, adjustable RET linkages are provided that include a first link that is configured to connect to a first RET rod, a second link that is configured to connect to a second RET rod, and a connecting member that has multiple attachment points for attaching to the first and/or second links. The first link may be connected to the connecting member by a first hinged connection and the second link may be connected to the connecting member by a second hinged connection. By selecting different of the attachment points, the length of the connecting member may be adjusted.

It will also be appreciated that the above embodiments may be combined in any manner. For example, an adjustable RET linkage may be provided that has any or all of a hinged connection, a sliding connection and a connecting member with multiple attachment points.

The adjustable RET linkages according to embodiments of the present invention may greatly reduce the number of RET linkages that a base station antenna manufacturer need design and develop. In addition, since the adjustable RET linkages may connect two RET rods that are spaced apart by a range of distances, the need to design new RET linkages to accommodate different RET rod configurations in new antenna designs may be greatly reduced.

Pursuant to further embodiments of the present invention, adjustable RET linkages are provided that are formed using two standardized parts and a selected one of a plurality of changeable parts. The standardized parts may comprise, for example, injection molded plastic parts that all have the same design that are each configured to be mounted on a RET rod of a base station antenna. The standardized parts may be used across a wide variety of different base station antenna designs, and hence may be manufactured in very high volumes. The changeable parts may be changeable connection members that extend between and connect two standardized parts so that the adjustable RET linkage will connect two RET rods together. A wide variety of different changeable connection members may be provided that are configured to span different distances in the width and depth directions of the antennas (and in the longitudinal direction as well in some cases), and the appropriate changeable connection member for any given adjustable RET linkage may be selected based at least in part on the distance between the RET rods that are to be joined in the width and depth directions. The changeable connection members may, for example, be metal parts that are stamped and/or bent from sheet metal and that have connection features at their opposed ends that allow each changeable connection member to be connected to two different standardized parts.

Embodiments of the present invention will now be discussed in greater detail with reference to the drawings. In some cases, two-part reference numerals are used in the drawings. Herein, elements having such two-part reference numerals may be referred to individually by their full reference numeral (e.g., linear array 120-2) and may be referred to collectively by the first part of their reference numerals (e.g., the linear arrays 120).

Figure 1B:
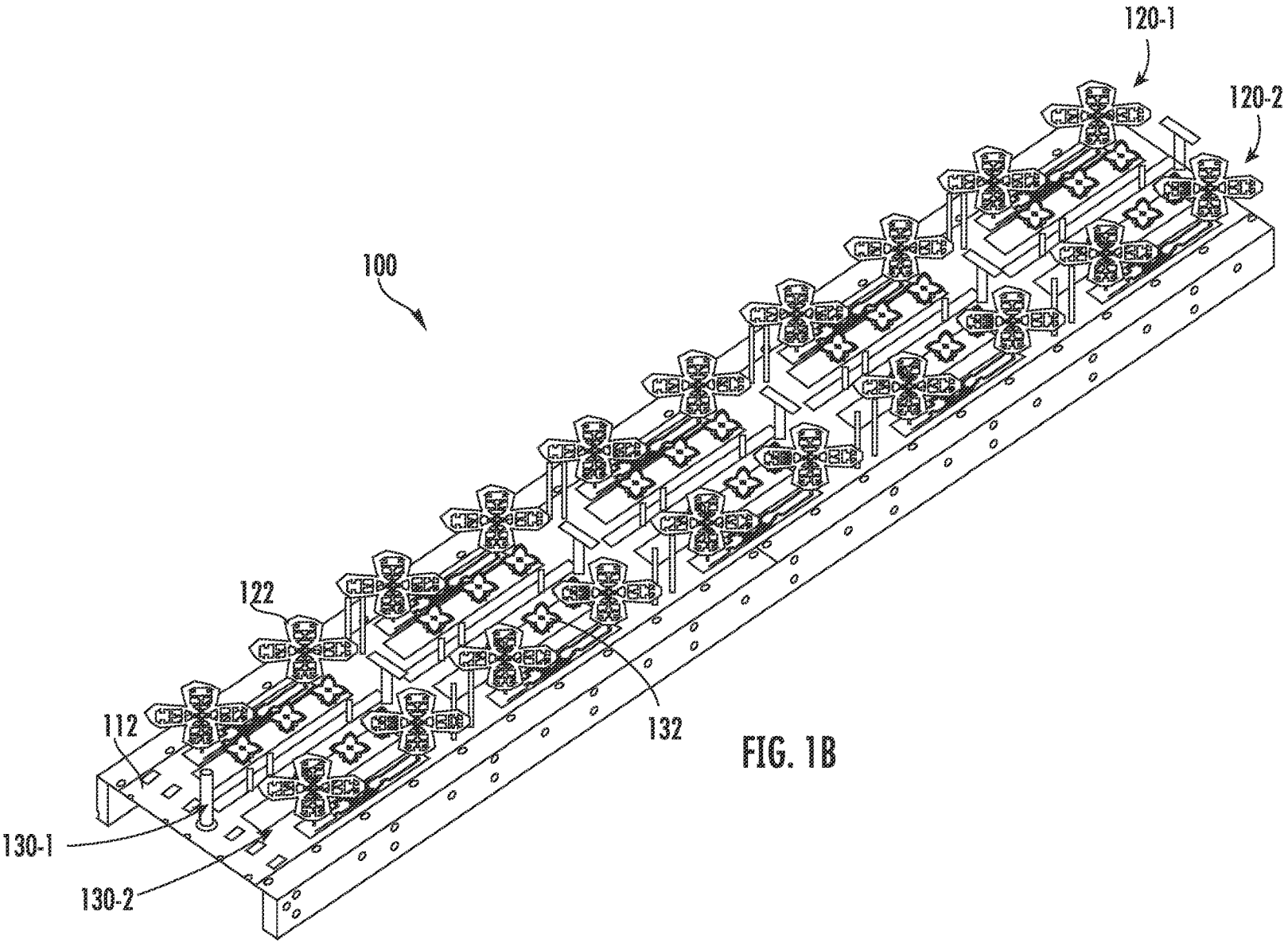
FIG. 1B is a perspective view of the base station antenna of FIG. 1A with the radome thereof removed.

FIG. 1A is a perspective view of a RET base station antenna 100 according to embodiments of the present invention. FIG. 1B is a perspective view of the base station antenna 100 with the radome removed to show the four linear arrays of radiating elements that are included in antenna 100.

As shown in FIG. 1A, the RET antenna 100 includes a radome 102, a mounting bracket 104, and a bottom end cap 106. A plurality of input/output ports 110 are mounted in the end cap 106. Coaxial cables (not shown) may be connected between the input/output ports 110 and the RF ports on one or more radios (not shown). These coaxial cables may carry RF signals between the radios and the base station antenna 100. The input/output ports 110 may also include control ports that carry control signals to the base station antenna 100 from a controller that is located remotely from base station antenna 100. These control signals may include control signals for electronically changing the tilt angle of the antenna beams generated by the base station antenna 100.

For ease of reference, FIG. 1A includes a coordinate system that defines the length (L), width (W) and depth (D) axes (or directions) of the base station antenna 100 that will be discussed throughout the application. The length axis may also be referred to as the longitudinal axis.

FIG. 1B is a perspective view of the base station antenna of FIG. 1A with the radome 102 removed. As shown in FIG. 1B, the base station antenna 100 includes two linear arrays 120-1, 120-2 of low-band radiating elements 122 (i.e., radiating elements that transmit and receive signals in a lower frequency band) and two linear arrays 130-1, 130-2 of high-band radiating elements 132 (i.e., radiating elements that transmit and receive signals in a higher frequency band). Each of the low-band radiating elements 122 is implemented as a cross-polarized radiating element that includes a first dipole that is oriented at an angle of −45° with respect to the azimuth plane and a second dipole that is oriented at an angle of +45° with respect to the azimuth plane. Similarly, each of the high-band radiating elements 132 is implemented as a cross-polarized radiating element that includes a first dipole that is oriented at an angle of −45° with respect to the azimuth plane and a second dipole that is oriented at an angle of +45° with respect to the azimuth plane. Since cross-polarized radiating elements are provided, each linear array 120-1, 120-2, 130-1, 130-2 will generate two antenna beams, namely a first antenna beam generated by the −45° dipoles and a second antenna beam generated by the +45° dipoles. The radiating elements 122, 132 extend forwardly from a backplane 112 with may comprise, for example, a sheet of metal that serves as a ground plane for the radiating elements 122, 132.

Figure 2:
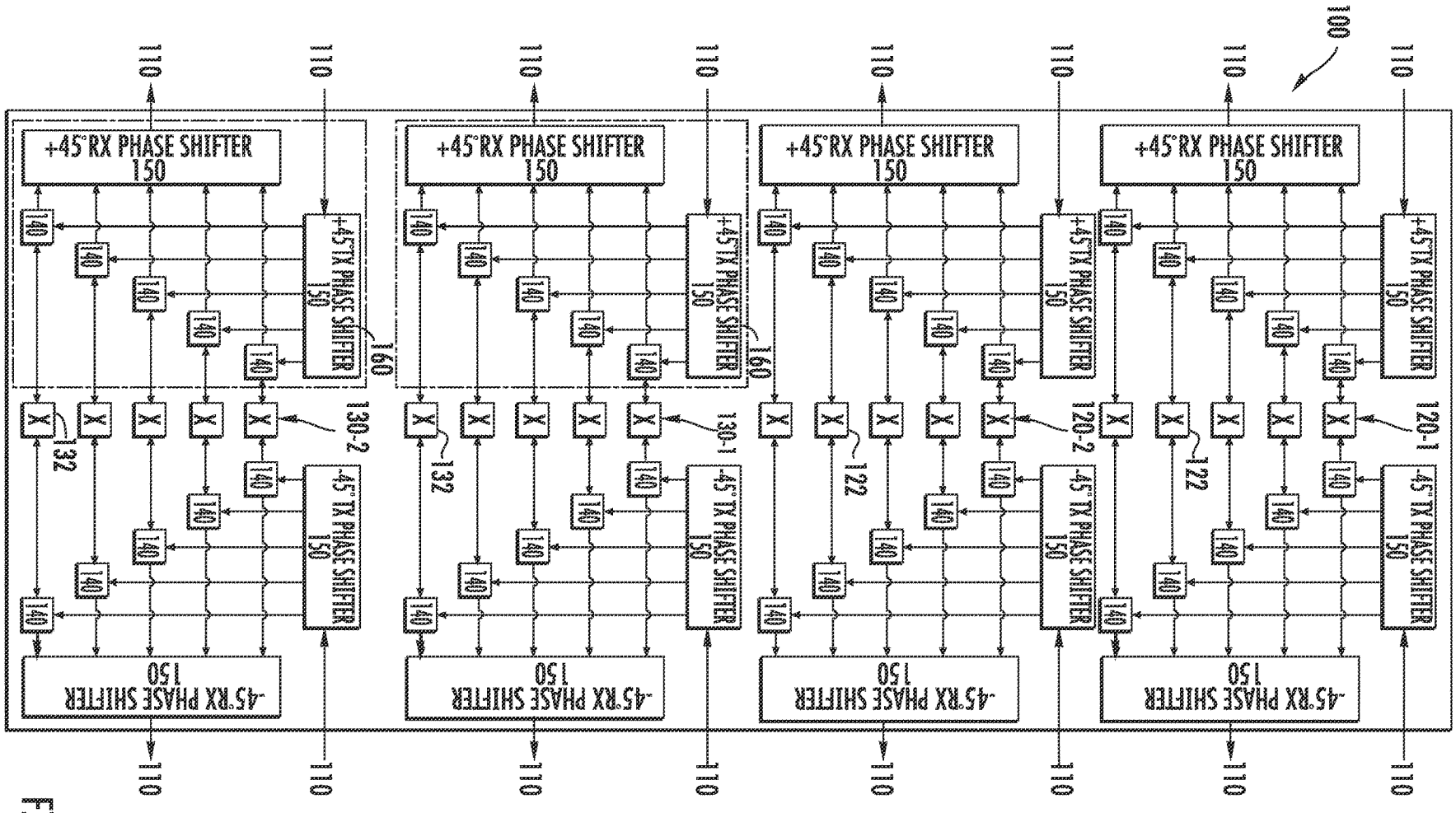
FIG. 2 is a schematic block diagram illustrating the electrical connections between various of the components of the base station antenna of FIGS. 1A-1B.

FIG. 2 is a schematic block diagram illustrating various additional components of the RET antenna 100 and the electrical connections therebetween. It should be noted that FIG. 2 does not show the actual location of the various elements on the antenna 100, but instead is drawn to merely show the electrical transmission paths between the various elements.

As shown in FIG. 2, each input/output port 110 may be connected to a phase shifter 150. The base station antenna 100 performs duplexing between the transmit and receive sub-bands for each linear array 120, 130 within the antenna (which allows different downtilts to be applied to the transmit and receive sub-bands), and hence each linear array 120, 130 includes both a transmit (input) port 110 and a receive (output) port 110. A first end of each transmit port 110 may be connected to the transmit port of a radio (not shown) such as a remote radio head. The other end of each transmit port 110 is coupled to a transmit phase shifter 150. Likewise, a first end of each receive port 110 may be connected to the receive port of a radio (not shown), and the other end of each receive port 110 is coupled to a receive phase shifter 150. Two transmit ports, two receive ports, two transmit phase shifters and to receive phase shifters are provided for each linear array 120, 130 to handle the two different polarizations.

Each transmit phase shifter 150 divides an RF signal input thereto into five sub-components, and applies a phase taper to these sub-components that sets the tilt (elevation) angle of the antenna beam generated by an associated linear array 120, 130 of radiating elements 122, 132. The five outputs of each transmit phase shifter 150 are coupled to five respective duplexers 140 that pass the sub-components of the RF signal output by the transmit phase shifter 150 to five respective sub-arrays of radiating elements 122, 132. In the example antenna 100 shown in FIGS. 1A, 1B and 2, each low-band linear array 120 includes ten low-band radiating elements 122 that are grouped as five sub-arrays of two radiating elements 122 each. Each high-band linear array 130 includes fifteen high-band radiating elements 132 that are grouped as five sub-arrays of three radiating elements 132 each.

Each sub-array of radiating elements passes received RF signals to a respective one of the duplexers 140, which in turn route those received RF signals to the respective inputs of an associated receive phase shifter 150. The receive phase shifter 150 applies a phase taper to each received RF signal input thereto that sets the tilt angle for the receive antenna beam and then combines the received RF signals into a composite RF signal. The output of each receive phase shifter 150 is coupled to a respective receive port 110.

While FIGS. 1B and 2 show an antenna having two linear arrays 120 of ten low-band radiating elements 122 each and two linear arrays 130 of fifteen high-band radiating elements 132 each, it will be appreciated that the number of linear arrays 120, 130 and the number of radiating elements 122, 132 included in each of the linear array 120, 130 may be varied. It will also be appreciated that duplexing may be done in the radios instead of in the antenna 100, that the number(s) of radiating elements 122, 132 per sub-array may be varied, that different types of radiating elements may be used (including single polarization radiating elements) and that numerous other changes may be made to the base station antenna 100 without departing from the scope of the present invention.

As can be seen from FIG. 2, the base station antenna 100 may include a total of sixteen phase shifters 150. While the two transmit phase shifters 150 for each linear array 120, 130 (i.e., one transmit phase shifter 150 for each polarization) may not need to be controlled independently (and the same is true with respect to the two receive phase shifters 150 for each linear array 120, 130), there still are eight sets of two phase shifters 150 that should be independently controllable. Accordingly, eight mechanical linkages may be required to connect the eight sets of phase shifters 150 to respective RET actuators.

Each phase shifter 150 shown in FIG. 2 may be implemented, for example, as a rotating wiper phase shifter. The phase shifts imparted by a phase shifter 150 to each subcomponent of an RF signal may be controlled by a mechanical positioning system that physically changes the position of the rotating wiper of each phase shifter 150, as will be explained with reference to FIG. 3. It will be appreciated that other types of phase shifters may be used instead rotating wiper phase shifters such as, for example, trombone phase shifters, sliding dielectric phase shifters and the like.

Figure 3:
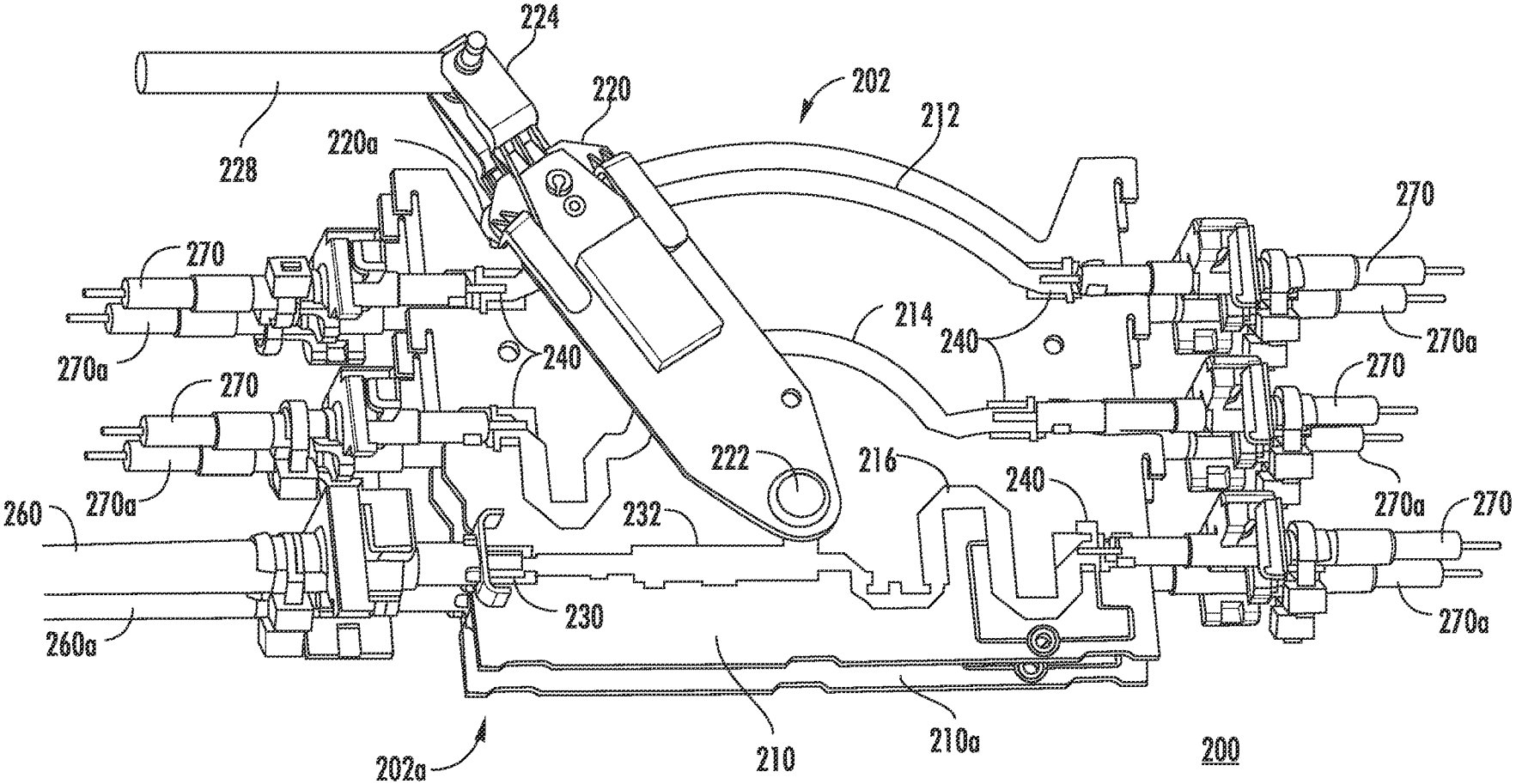
FIG. 3 is a front perspective view of a pair of electromechanical phase shifters that may be included in the base station antenna of FIGS. 1A-1B.

Referring to FIG. 3, a dual rotating wiper phase shifter assembly 200 is illustrated that may be used to implement, for example, two of the phase shifters 150 of FIG. 2. The dual rotating wiper phase shifter assembly 200 includes first and second phase shifters 202, 202*a*. In the description of FIG. 3 that follows it is assumed that the two phase shifters 202, 202*a* are each transmit phase shifters that have one input and five outputs. It will be appreciated that if the phase shifters 202, 202*a* are instead used as receive phase shifters then the terminology changes, because when used as receive phase shifters there are five inputs and a single output.

As shown in FIG. 3, the dual phase shifter 200 includes first and second main (stationary) printed circuit boards 210, 210*a* that are arranged back-to-back as well as first and second rotatable wiper printed circuit boards 220, 220*a* (wiper printed circuit board 220*a* is barely visible in the view of FIG. 3) that are rotatably mounted on the respective main printed circuit boards 210, 210*a*. The wiper printed circuit boards 220, 220*a* may be pivotally mounted on the respective main printed circuit boards 210, 210*a* via a pivot pin 222. The wiper printed circuit boards 220, 220*a* may be joined together at their distal ends via a bracket 224.

The position of each rotatable wiper printed circuit boards 220, 220*a* above its respective main printed circuit board 210, 210*a* is controlled by the position of a drive shaft 228 (partially shown in FIG. 3), the end of which may constitute one end of a mechanical linkage. The other end of the mechanical linkage (not shown) may be coupled to an output member of a RET actuator.

Each main printed circuit board 210, 210*a* includes transmission line traces 212, 214. The transmission line traces 212, 214 are generally arcuate. In some cases the arcuate transmission line traces 212, 214 may be disposed in a serpentine pattern to achieve a longer effective length. In the example illustrated in FIG. 3, there are two arcuate transmission line traces 212, 214 per main printed circuit board 210, 210*a* (the traces on printed circuit board 210*a* are not visible in FIG. 3), with the first arcuate transmission line trace 212 being disposed along an outer circumference of each printed circuit board 210, 210*a*, and the second arcuate transmission line trace 214 being disposed on a shorter radius concentrically within the outer transmission line trace 212. A third transmission line trace 216 on each main printed circuit board 210, 210*a* connects an input pad 230 on each main printed circuit board 210, 210*a* to an output pad 240 that is not subjected to an adjustable phase shift.

The main printed circuit board 210 includes one or more input traces 232 leading from the input pad 230 near an edge of the main printed circuit board 210 to the position where the pivot pin 222 is located. RF signals on the input trace 232 are coupled to a transmission line trace (not visible in FIG. 3) on the wiper printed circuit board 220, typically via a capacitive connection. The transmission line trace on the wiper printed circuit board 220 may split into two secondary transmission line traces (not shown). The RF signals are capacitively coupled from the secondary transmission line traces on the wiper printed circuit board 220 to the transmission line traces 212, 214 on the main printed circuit board. Each end of each transmission line trace 212, 214 may be coupled to a respective output pad 240. A coaxial cable 260 or other RF transmission line component may be connected to input pad 230. A respective coaxial cable 270 or other RF transmission line component may be connected to each respective output pad 240. As the wiper printed circuit board 220 moves, an electrical path length from the input pad 230 of phase shifter 202 to each output pad 240 changes. For example, as the wiper printed circuit board 220 moves to the left it shortens the electrical length of the path from the input pad 230 to the output pad 240 connected to the left side of transmission line trace 212 (which connects to a first sub-array of radiating elements), while the electrical length from the input pad 230 to the output pad 240 connected to the right side of transmission line trace 212 (which connects to a second sub-array of radiating elements) increases by a corresponding amount. These changes in path lengths result in phase shifts to the signals received at the output pads 240 connected to transmission line trace 212 relative to, for example, the output pad 240 connected to transmission line trace 216.

The second phase shifter 202*a* may be identical to the first phase shifter 202. As shown in FIG. 3, the rotating wiper printed circuit board 220*a* of phase shifter 202*a* may be controlled by the same drive shaft 228 as the rotating wiper printed circuit board 220 of phase shifter 202.

Figure 4:
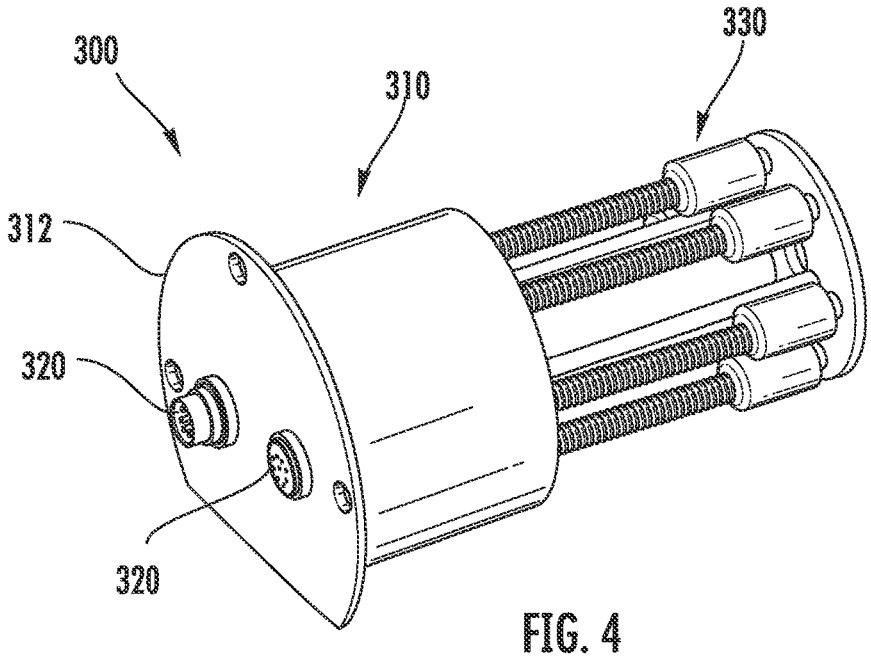
FIG. 4 is perspective view of a multi-RET actuator that may be included in the base station antenna of FIGS. 1A-1B.

As noted above, a RET actuator is used to drive the moveable element of a phase shifter 150. FIG. 4 is a perspective view of an example RET actuator that may be used in the base station antennas according to embodiments of the present invention. The RET actuator 300 is a multi-RET actuator that includes multiple output members that can drive multiple respective mechanical linkages.

As shown in FIG. 4, the multi-RET actuator 300 includes a housing 310 and a pair of connectors 320 that are mounted so as to extend through the housing 310. The connectors 320 may connect to communications cables that may be used to deliver control signals from a base station control system to the multi-RET actuator 300.

The multi-RET actuator 300 further includes eight generally parallel worm gear shafts 340 that extend along respective parallel axes (only four of the worm gear shafts 340 are visible in FIG. 4). The worm gear shafts 340 are rotatably mounted in the housing 310. A drive motor (not shown) may be mounted in the housing 310 that may be used to rotate a selected one of the worm gear shafts 340. Various selection mechanisms may also be mounted within the housing 310 that may be used to select one of the worm gear shafts 340 so that the drive motor is operatively connected to the selected worm gear shaft 340.

An internally threaded piston 350 is mounted on each worm gear shaft 340 and is configured (e.g., via threads) to move axially relative to the worm gear shaft 340 upon rotation of the worm gear shaft 340. Each piston 350 may be connected to a mechanical linkage (not shown) that connects the piston 350 to a moveable element on one or more phase shifters of the antenna, such that axial movement of the piston 350 can be used to apply a phase taper to the sub-components of RF signals that are transmitted and received through a linear array of the antenna. Each piston 350 may be moved in either direction along its associated worm gear shaft 340 by changing the direction of rotation of the worm gear shaft 340.

Figure 5:
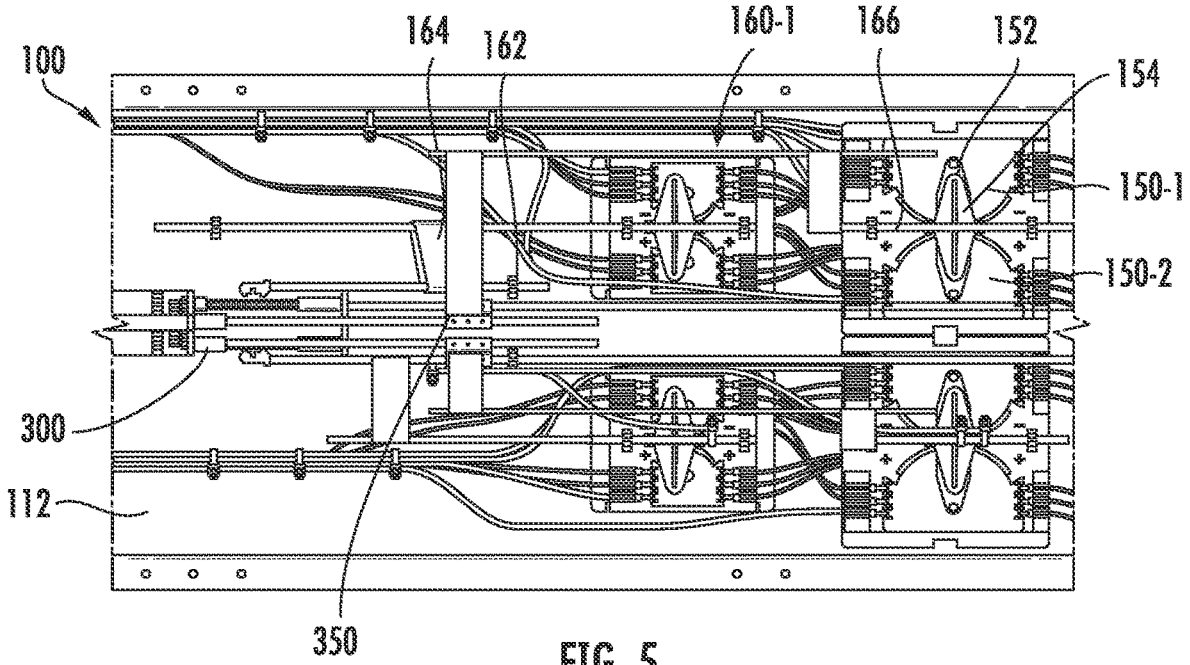
FIG. 5 is a rear view of a portion of the base station antenna of FIGS. 1A-1B that shows how mechanical linkages are used to connect the output members of the multi-RET actuator of FIG. 4 to respective ones of the phase shifters illustrated in FIGS. 2 and 3.

FIG. 5 is a rear view of a portion of the base station antenna 100 that shows how mechanical linkages 160 are used to connect the output members of the RET actuator 300 (i.e., the pistons 350) to moveable elements of respective pairs of phase shifters 150. In FIG. 5, only a few of the elements have been given reference numerals to simplify the drawing (e.g., only one of the mechanical linkages and two of the phase shifters are given reference numerals).

As shown in FIG. 5, a multi-RET actuator 300 is mounted in the antenna 100 behind the backplane 112. Eight pairs of phase shifters 150 are also mounted rearwardly of the backplane 112 (only four pairs of phase shifters are visible in FIG. 5). Since the base station antenna 100 has linear arrays 120, 130 that are formed of dual-polarized radiating elements 122, 132, the phase shifters 150 are mounted in pairs since the phase shifter 150 for each polarization will be adjusted the same amount. In FIG. 5, phase shifters 150-1 and 150-2 are used to adjust the phase tapers applied to the first and second polarization radiators of the radiating elements 122 of linear array 120-1.

As is further shown in FIG. 5, a plurality of mechanical linkages 160 are provided that connect each output member 350 of the multi-RET actuator 300 to a respective pair of phase shifters 150. For example, mechanical linkage 160-1 is connected between one of the pistons 350 of RET actuator 300 and a slider 154 of the phase shifter assembly that engages and rotationally moves the respective wiper arms 152 of phase shifters 150-1 and 150-2. As shown in FIG. 5, the mechanical linkage 160-1 includes a first RET rod 162 that is attached to the piston 350 of multi-RET actuator 300, a second RET rod 166, a first RET linkage 164 that connects the first RET rod 162 to the second RET rod 166, and the slider 154 that engages the wiper arms 152 of the phase shifters 150-1, 150-2. The RET rods 162, 166 may comprise, for example, generally rigid fiberglass longitudinally-extending rods. The other three mechanical linkages 160 shown in FIG. 5 include similar combinations of RET rods 162, 166 and RET linkages 164. The RET rods 162, 166 typically extend in a longitudinal direction of the antenna 100, while the RET linkages 164 typically extend along the width and/or depth axes to connect two RET rods 162, 166 together, and/or to connect a RET rod 162, 166 to an output member of the RET actuator or to a moveable element of a phase shifter assembly such as the slider 154 that engages the wiper arms 152. Each mechanical linkage 160 is used to transfer a linear movement of the output member 350 of the RET actuator 300 to a slider 154, although in other embodiments rotational movement may be transferred by the mechanical linkage.

As can be seen from FIG. 5, the mechanical linkages 160 typically include multiple RET rods 162, 166 and/or multiple RET linkages 164 because the output members of the RET actuator(s) 350 are typically not longitudinally aligned with the moveable elements 152, 154 of the phase shifters 150. Offsets or "jogs" along the width and/or depth axes may also be required in a mechanical linkage 160 in order to route the mechanical linkage 160 around other elements in the antenna 100. Moreover, each RET linkage 164 typically spans different distances in the width and/or depth directions as compared to other ones of the RET linkages 164. As a result, a base station antenna manufacturer may need to manufacture and maintain in inventory a wide variety of different RET linkages 164.

Figure 6A:
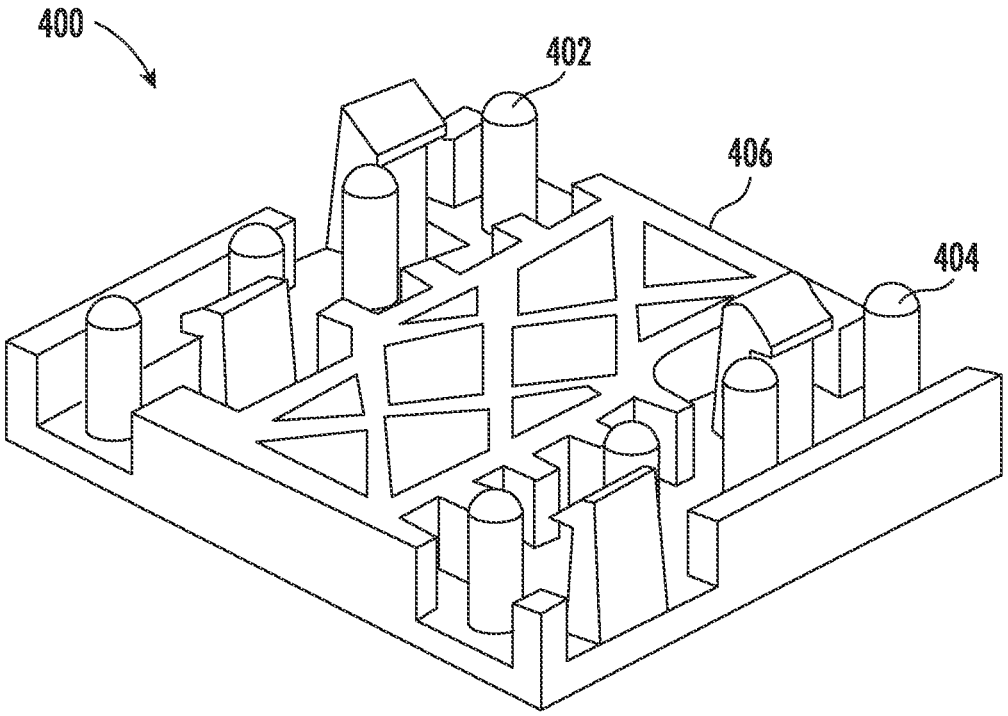
FIG. 6A PRIOR ART
FIGS. 6A-6G are perspective views of examples of conventional RET linkages.
Figure 6B:
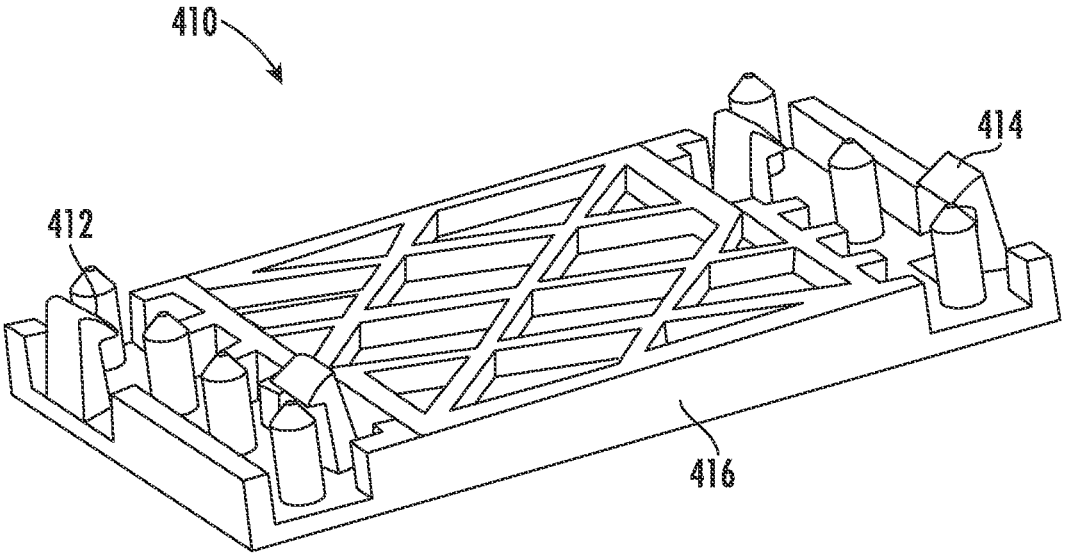
FIG. 6B PRIOR ART

For example, FIGS. 6A-6G are perspective views of conventional RET linkages that are designed to span different widths and/or depths. In particular, FIGS. 6A and 6B illustrate RET linkages that span different widths with no change in depth. As shown in FIG. 6A, a conventional RET linkage 400 includes a first connection element 402, a second connection element 404 and a connecting member 406 that connects the first connection element 402 to the second connection element 404. FIG. 6B shows a similar conventional RET linkage 410 that includes a first connection element 412, a second connection element 414 and a connecting member 416, with the only significant difference between the RET linkages 400 and 410 is that RET linkage 410 has a longer connecting member 416 than the connecting member 406 of RET linkage 400, so that RET linkage 410 can be used to connect two elements of a mechanical linkage 160 that are spaced farther apart in the width direction. RET linkages 400 and 410 are designed to connect elements of a mechanical linkage 160 (e.g., first and second RET rods 162, 166) that are spaced apart from each other in the width direction but at the same depth behind the backplane 112.

Figure 6C:
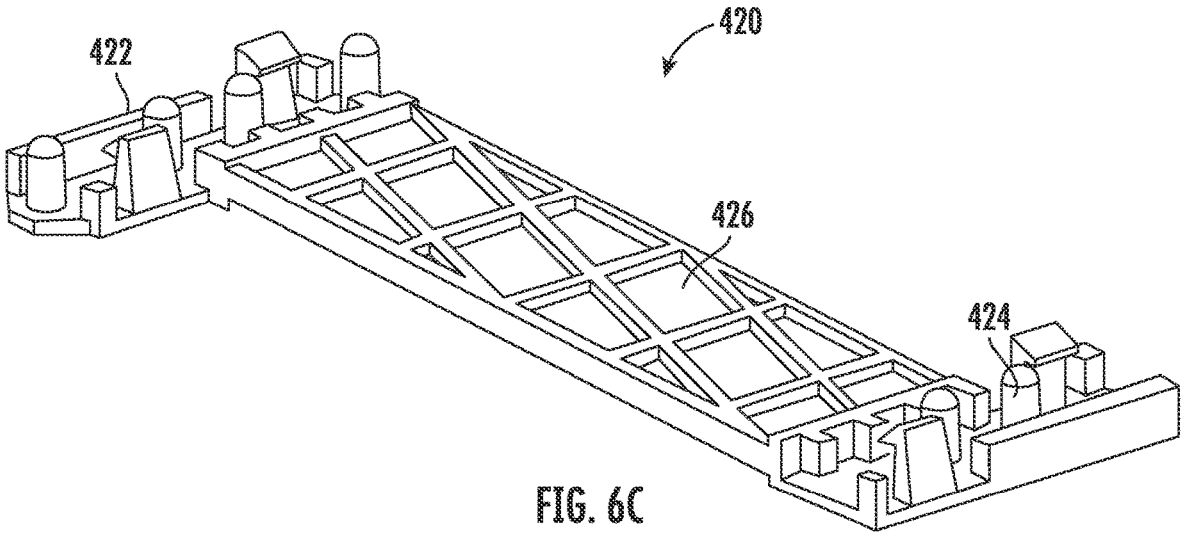
FIG. 6C PRIOR ART
Figure 6D:
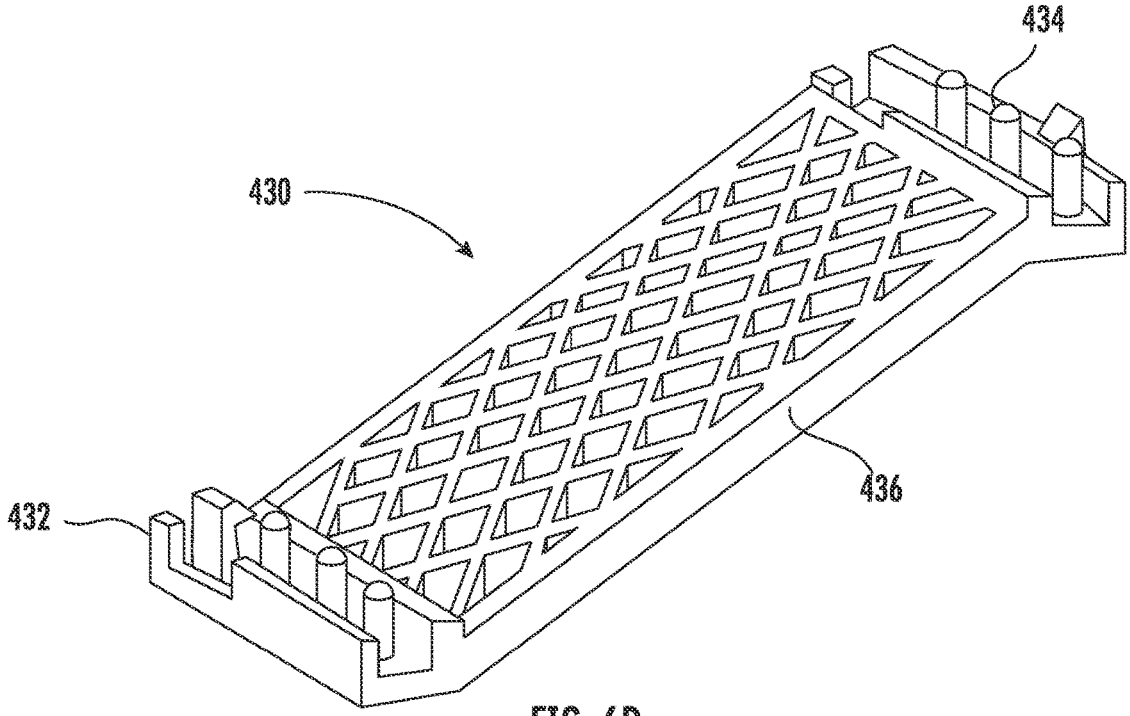
FIG. 6D PRIOR ART

FIGS. 6C and 6D illustrate conventional RET linkages that are used to connect two elements of a mechanical linkage that are spaced apart in both the width and depth directions. The RET linkage 420 shown in FIG. 6C includes a first connection element 422, a second connection element 424 and a connecting member 426. The connecting member 426 extends at an acute angle between the first and second connecting elements 422, 424, thereby configuring the RET linkage 420 to connect two elements of a mechanical linkage 160 that are spaced apart in both the width and depth directions. The RET linkage 430 shown in FIG. 6D includes a similar design, having a first connection element 432, a second connection element 434 and a connecting member 436. The RET linkage 430 is designed to connect two elements of a mechanical linkage 160 that are spaced apart by a relatively large distance in the depth direction.

RET rods such as RET rods 162, 166 in FIG. 5 often have generally square or rectangular cross-sections. Moreover, in many cases, different RET rods 162, 166 in a mechanical linkage 160 may be angularly rotated with respect to one another. For example, when a RET rod 166 having a generally rectangular cross-section is attached to a phase shifter 150, typically a side of the RET rod 162, 166 will be coplanar with the backplane 112 of the antenna 100. However, when a multi-RET actuator such as the multi-RET actuator 300 of FIG. 4 is used that has output members 350 that are arranged along the circumference of a cylinder, at least some of the RET rods 162 that attach to the output members of the RET actuator 300 may be angled with respect to the backplane 112 of the antenna 100. As a result, a RET linkage 164 that is designed to connect these two different types of RET rods 162, 166 may require first and second connection elements that are at different angular rotations. Examples of such RET linkages are shown in FIGS. 6E and 6F.

Figure 6E:
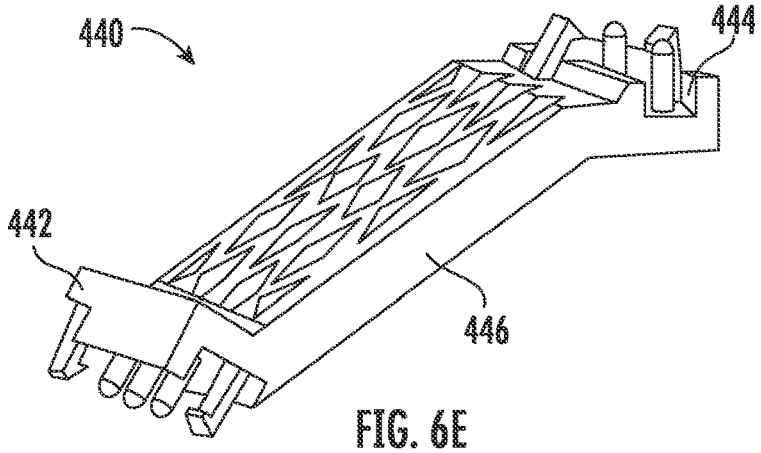
FIG. 6E PRIOR ART
Figure 6F:
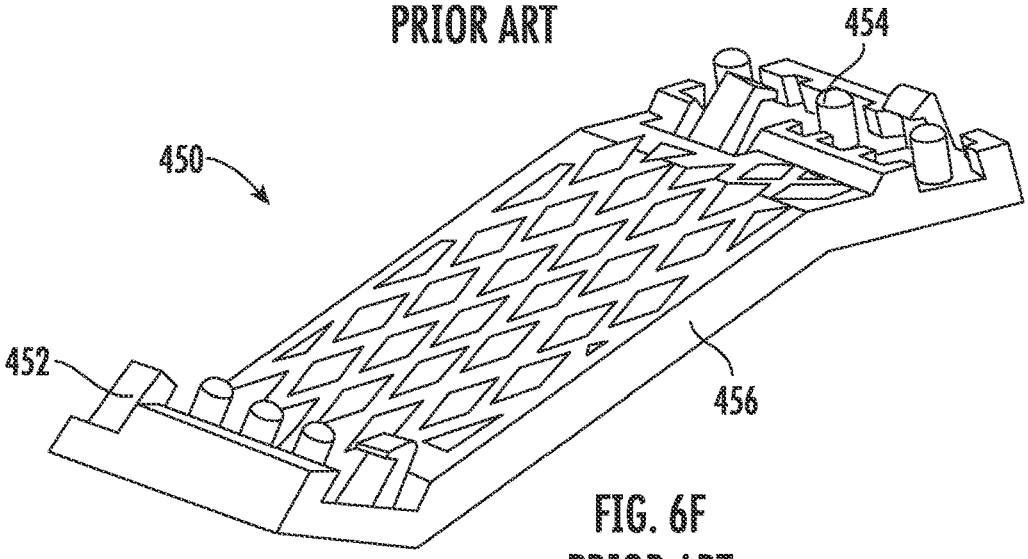
FIG. 6F PRIOR ART

In particular, as shown in FIG. 6E, a conventional RET linkage 440 includes a first connection element 442, a second connection element 444 and a connecting member 446. The first and second connection elements 442, 444 have different angular rotations, and thus the RET linkage 440 is designed to connect two RET rods 162, 166 that have different angular rotations. FIG. 6F illustrates a conventional RET linkage 450 that includes a first connection element 452, a second connection element 454 and a connecting member 456 that has a similar design to RET linkage 440 but which accommodates a different angular rotation.

Figure 6G:
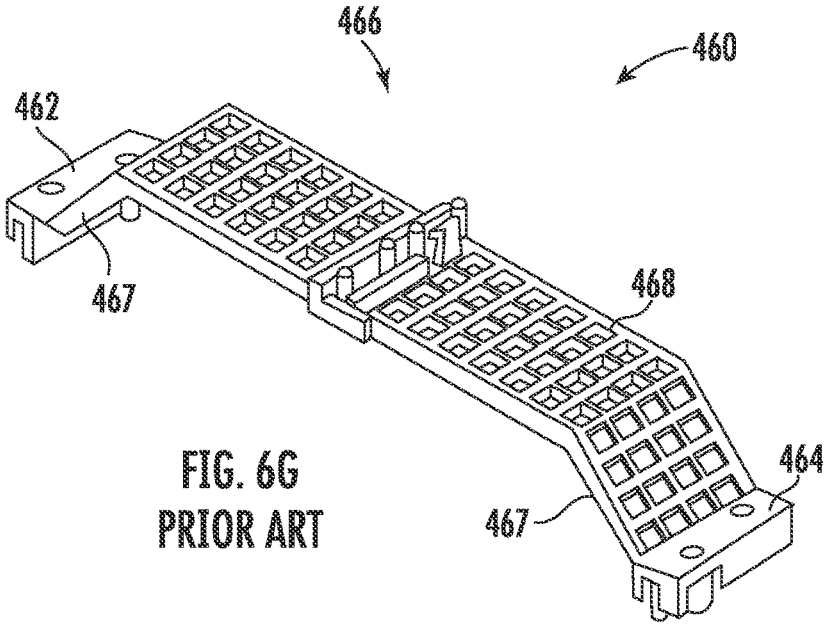
FIG. 6G PRIOR ART

Finally, in some instances, RET linkages may be designed to avoid other stationary elements in an antenna. For example, FIG. 6G illustrates a conventional RET linkage 460 that includes a first connection element 462, a second connection element 464 and a connecting member 466. The connecting member 466 includes a pair of ramps 467 that are connected by a planar segment 468. The ramps 467 may be used to change the depth of the planar segment 468 so that the connecting member 466 may not run into another element of a base station antenna (not shown) when a mechanical linkage that includes RET linkage 460 moves during normal operation.

Figure 7:
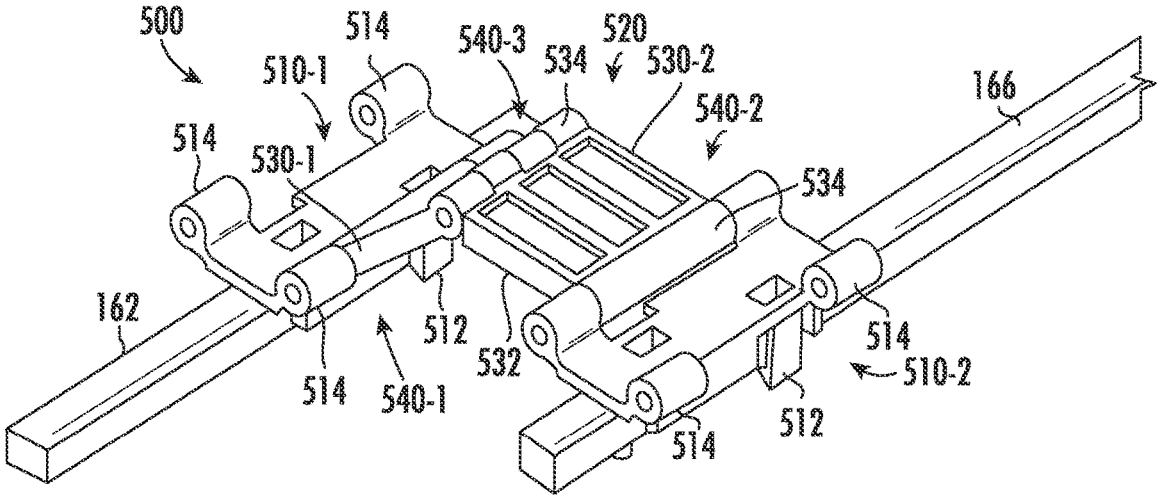
FIG. 7 is a perspective view of an adjustable RET linkage according to embodiments of the present invention.

FIG. 7 is a perspective view of an adjustable RET linkage 500 according to embodiments of the present invention. As shown in FIG. 7 the adjustable RET linkage 500 includes a first link 510-1 that has a first connection element 512 that connects to a first RET rod 162, a second link 510-2 that has a second connection element 512 that connects to a second RET rod 166, and a connecting member 520 that connects the first link 510-1 to the second link 510-2. In the embodiment of FIG. 7, the connecting member 520 comprises a pair of links 530-1, 530-2 that are pivotally connected to each other. As can also be seen in FIG. 7, the first link 510-1 is pivotally connected to the one end of the connecting member 520 and the second link 510-2 is pivotally connected to the other end of the connecting member 520. Thus, the adjustable RET linkage 500 pivots in three different locations which allows the adjustable RET linkage 500 to span a wide range of distances in the width and depth directions. The adjustable RET linkage 500 also includes locking mechanisms (discussed below) that can be used to lock each pivotal connection in a respective configuration so that after the adjustable RET linkage 500 has been adjusted to connect two elements (e.g., RET rods 162, 166) of a mechanical linkage 160, the three pivoting connections may be fixed so that the adjustable RET linkage 500 is transformed into a rigid element that efficiently transfers force between the two elements of a mechanical linkage 160.

As shown in FIG. 7, the first and second links 510-1, 510-2 may be identical in some embodiments. The first connection element 512 extends downwardly from the first link 510-1 and may be used to mount the first link 510-1 on the first RET rod 162. In the depicted embodiment, the connection elements 512 each comprise a series of posts that are received within corresponding cylindrical holes in respective first and second RET rods 162, 166 (not shown in FIGS. 12A-12B) along with a pair of snap clips that hold the respective RET rods 162, 166 in place with the posts inserted into the holes in the RET rods 162, 166. It will be appreciated, however, that any of a wide variety of connection elements may be used such as posts, screws, hook and link fasteners, recesses, and the like. The connection elements 512 may comprise male connection elements that mate with female connection elements on the RET rods, female connection elements that mate with male connection elements on the RET rods, a combination of male and female connection elements and/or connection elements that are neither male nor female in character.

The first link 510-1 further includes one or more annular receptacles 514. In the depicted embodiment, the first link 510-1 includes a first pair of spaced apart and longitudinally-aligned annular receptacles 514 that extend upwardly from a first side of the first link 510-1 and a second pair of spaced apart and longitudinally-aligned annular receptacles 514 that extend upwardly from a second side of the first link 510-1 that is opposite the first side. One of the pairs of annular receptacles 514 may comprise part of a first hinge 540-1, as will be discussed below. By providing one or more annular receptacles 514 on each side of the first link 510-1, the first hinge 540-1 may be formed to extend from either side of the first link 510-1. The second link 510-2 may be identical to the first link 510-1, and hence further description thereof will be omitted.

The connecting member 520 includes a third link 530-1 and a fourth link 530-2. The third and fourth links 530-1, 530-2 may each extend in the width and/or depth directions. In the depicted embodiment, the third and fourth links 530-1 and 530-2 may be identical to each other. Each link 530-1, 530-2 includes a planar segment 532 and one or more annular receptacles 534. In the depicted embodiment, each link 530 includes a first annular receptacle 534 that extends from a first side of the planar segment 532 and second and third annular receptacles 534 that are arranged as a pair of spaced apart and longitudinally-aligned annular receptacles 534 that extend from a second side of each link 530. The first annular receptacle 534 on the third link 530-1 may, together with one of the pairs of annular receptacles 514 included on the first link 510-1, form the first hinge 540-1 that provides the pivotal connection between the first link 510-1 and the third link 530-1. The first annular receptacle 534 on the fourth link 530-2 may, together with one of the pairs of annular receptacles 514 included on the second link 510-2, form a second hinge 540-2 that provides the pivotal connection between the second link 510-2 and the fourth link 530-2. The pairs of annular receptacles 534 on the third and fourth links 530 are intermeshed to form a third hinge 540-3 that provides the pivotal connection between the third link 530-1 and the fourth link 530-2. While not visible in FIG. 7, it will be appreciated that a bolt or rod may be inserted through the annular receptacles 514, 535 that form each of the first through third hinges 540-1 through 540-3.

Figure 14A:
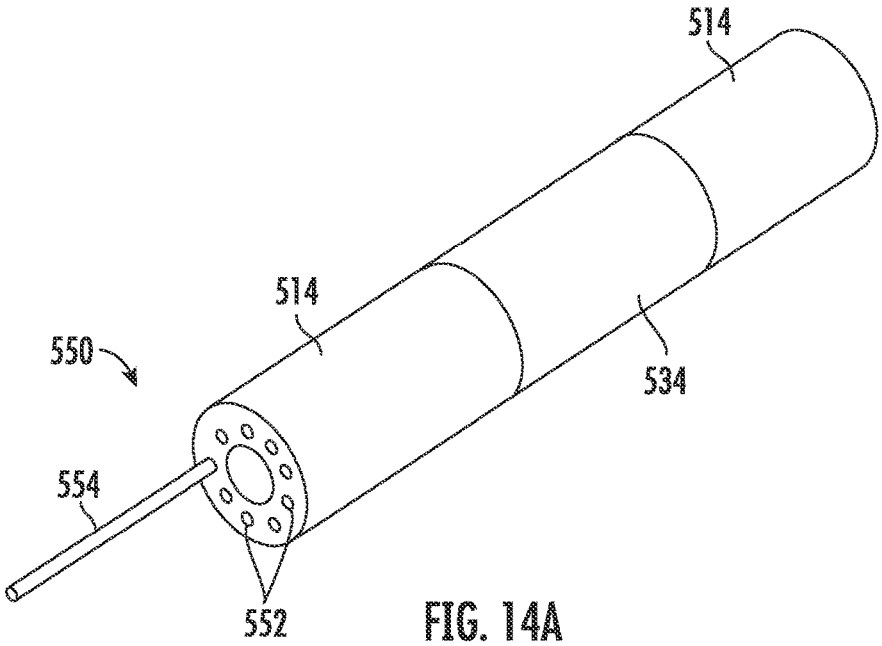
FIGS. 14A and 14B are schematic perspective views illustrating two example locking mechanisms that may be included on the adjustable RET linkages according to embodiments of the present invention.
Figure 14B:
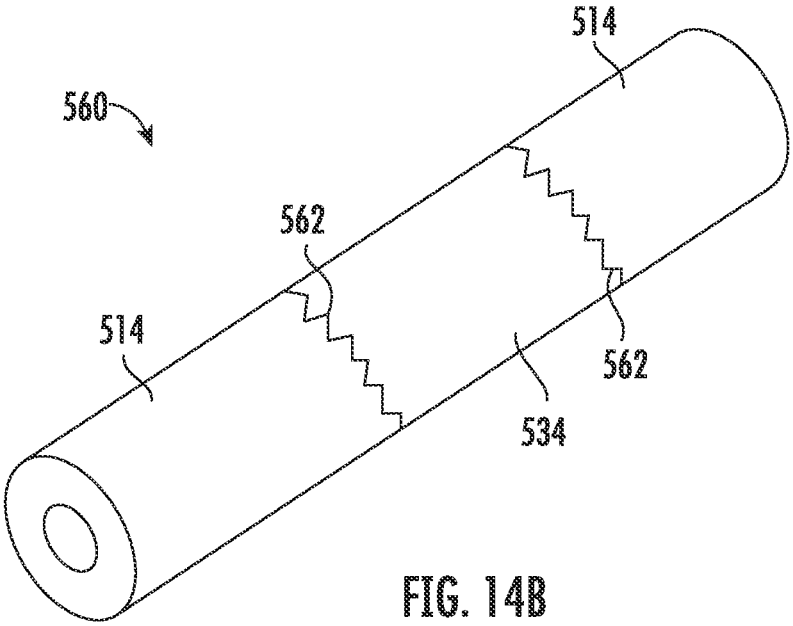

The adjustable RET linkage 500 may further include locking mechanisms that may be used to lock the first through third hinges 540-1 through 540-3 in place so that each hinge 540 becomes fixed once the adjustable RET linkage 500 has been installed on two members 162, 166 of a mechanical linkage 160. Any appropriate locking mechanism may be used. As one simple example, an adhesive such as glue could be used to fix each hinge 540 at a desired angle. FIG. 14A illustrates another locking mechanism 550 in which slots 552 are formed through the sidewalls of the annular receptacles 514, 534 that form each hinge 540. A pin 554 may be inserted through the slots 552 of the annular receptacles 514, 534 to render the hinge 540 formed thereby immobile. FIG. 14B illustrates yet another locking mechanism 560 in which mating teeth 562 are formed along the edges of adjacent annular receptacles 514, 534. These teeth 562 may increase the force necessary to rotate each hinge 540 so that the hinge 540 will effectively remain locked in a desired position. Numerous other suitable locking mechanisms will be apparent to those of skill in the art.

The first through third hinged connections 540-1 through 540-3 allow the adjustable RET linkage 500 to be fixed to extend for any of a range of different widths and/or different depths. This allows the adjustable RET linkage 500 to be used to connect two RET rods that are spaced apart by any distance in the width and/or depths directions within this range, as is shown in FIGS. 8A-8D.

Figure 8A:
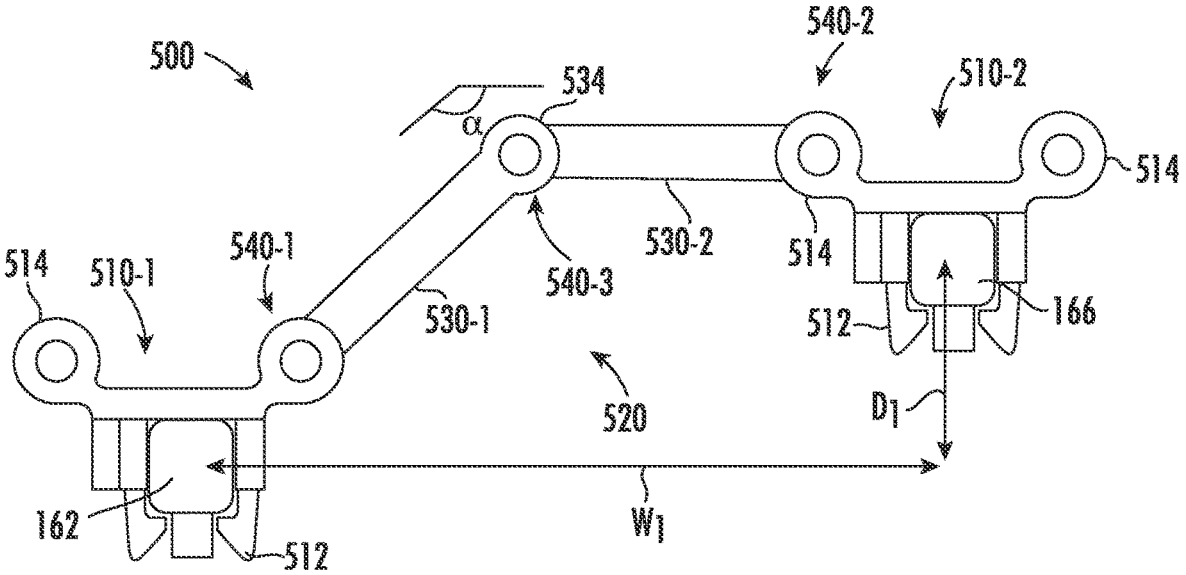
FIGS. 8A-8D are side views illustrating how the adjustable RET linkage of FIG. 7 may be configured to connect to elements of a mechanical linkage that are spaced apart from each other by different distances.
Figure 8B:
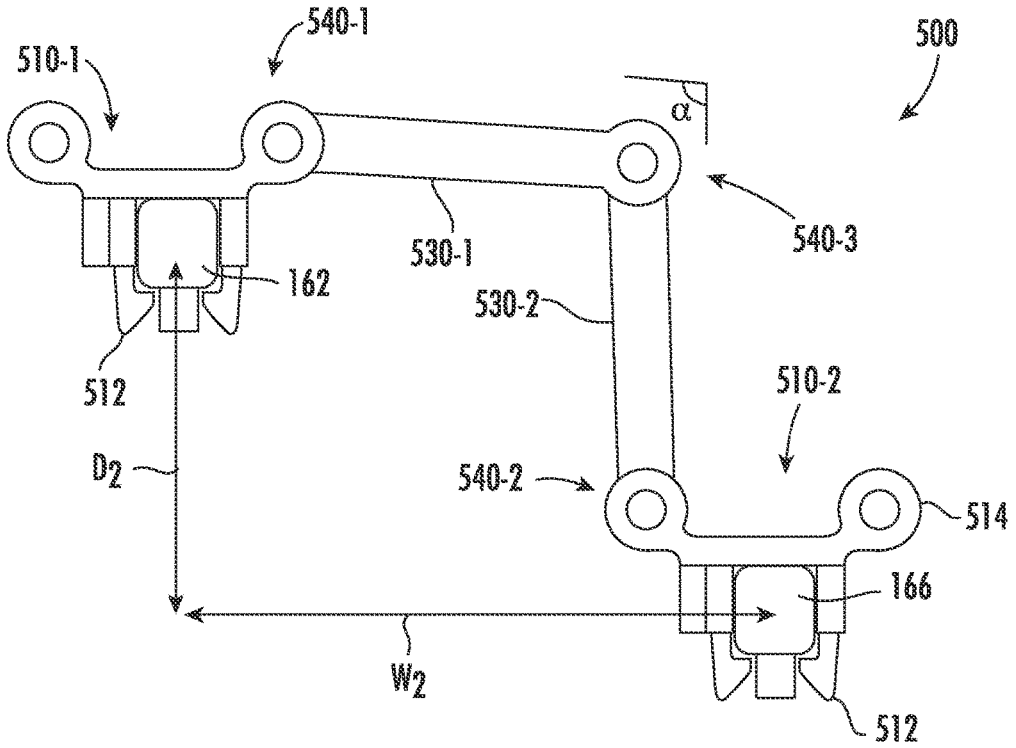

In particular, as shown in FIGS. 8A and 8B, the three hinged connections 540-1 through 540-3 allow the adjustable RET linkage 500 to span a range of different distances in the width and depth directions between two RET rods 162, 166. FIG. 8A illustrates an example where the first RET rod 162 is located farther behind the backplane 112 than the second RET rod 166. FIG. 8B illustrates an example where the first RET rod 162 is located closer to the backplane 112 than the second RET rod 166. FIGS. 8A and 8B also illustrate how the hinges 540-1 through 540-3 allow the adjustable RET linkage 500 to span different widths. For example, in FIG. 8A, the adjustable RET linkage 500 is configured to connect first and second RET rods 162, 166 that are separated by a distance W1 in the width direction and a distance D1 in the depth direction, while in FIG. 8B the adjustable RET linkage 500 is configured to connect first and second RET rods 162, 166 that are separated by a distance W2 in the width direction that is less than distance W1 and a distance D2 in the depth direction that is greater than distance D1.

Figure 8C:
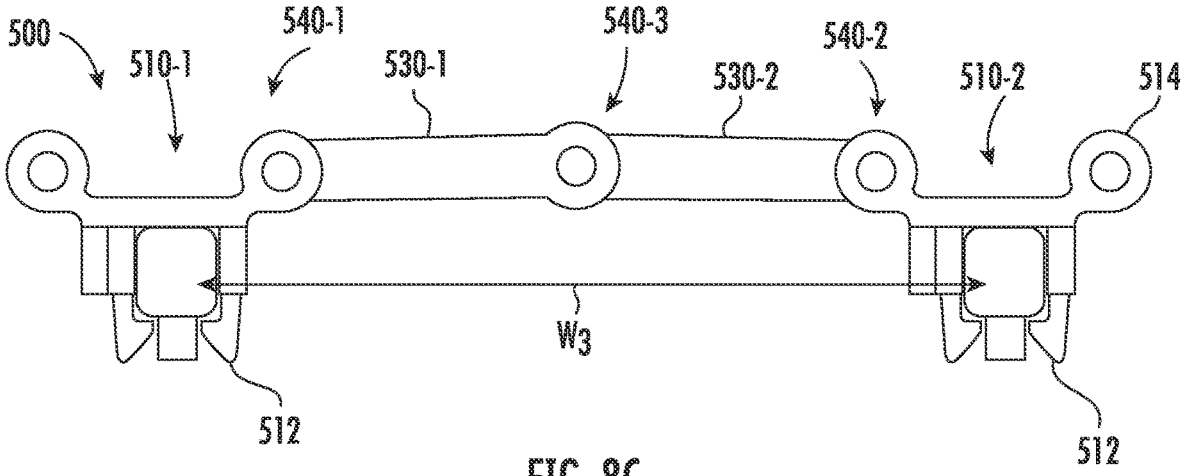
Figure 8D:
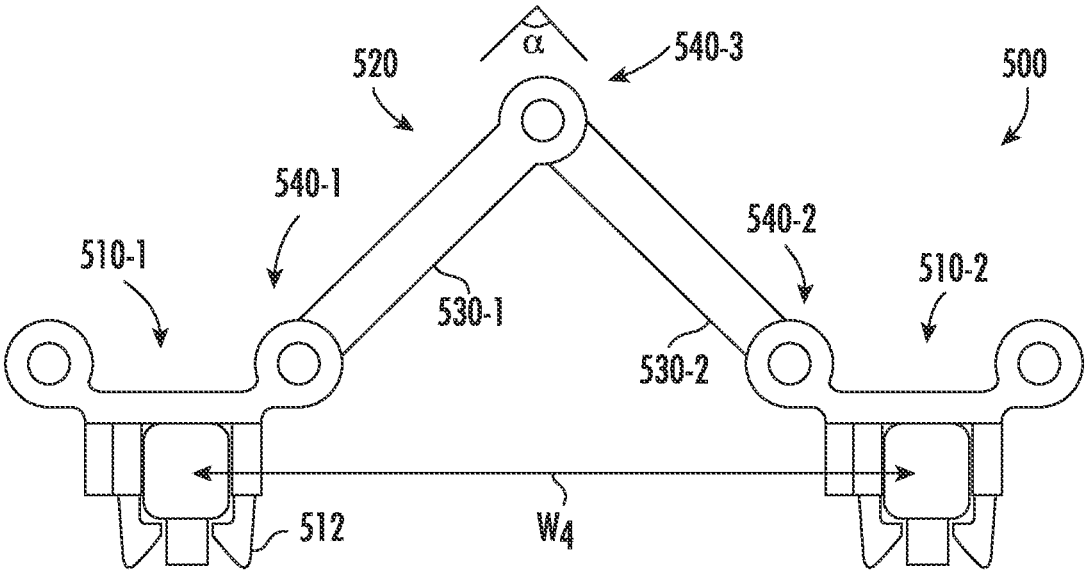

FIGS. 8C and 8D similarly show how the adjustable RET linkage 500 may be used to connect first and second RET rods 162, 166 that are at the same depth behind the backplane and separated by a third distance W3 in the width direction or may alternatively be used to connect first and second RET rods 162, 166 that are at the same depth behind the backplane and separated by a fourth distance W4 in the width direction that is less than distance W3.

As can best be seen in FIGS. 8A and 8B, the distance in the width direction spanned by the adjustable RET linkage 500 may be increased by increasing the angle $\alpha$ defined by the third and fourth links 530-1, 530-2 that are connected by the third hinge 540-3. The distance in the width direction spanned by the adjustable RET linkage 500 may also be increased by changing the angle defined by the first hinge 540-1 and/or by changing the angle defined by the second hinge 540-2. Likewise the distance in the depth direction spanned by the adjustable RET linkage 500 may be increased by increasing any or all of the above-referenced angles.

Figure 9A:
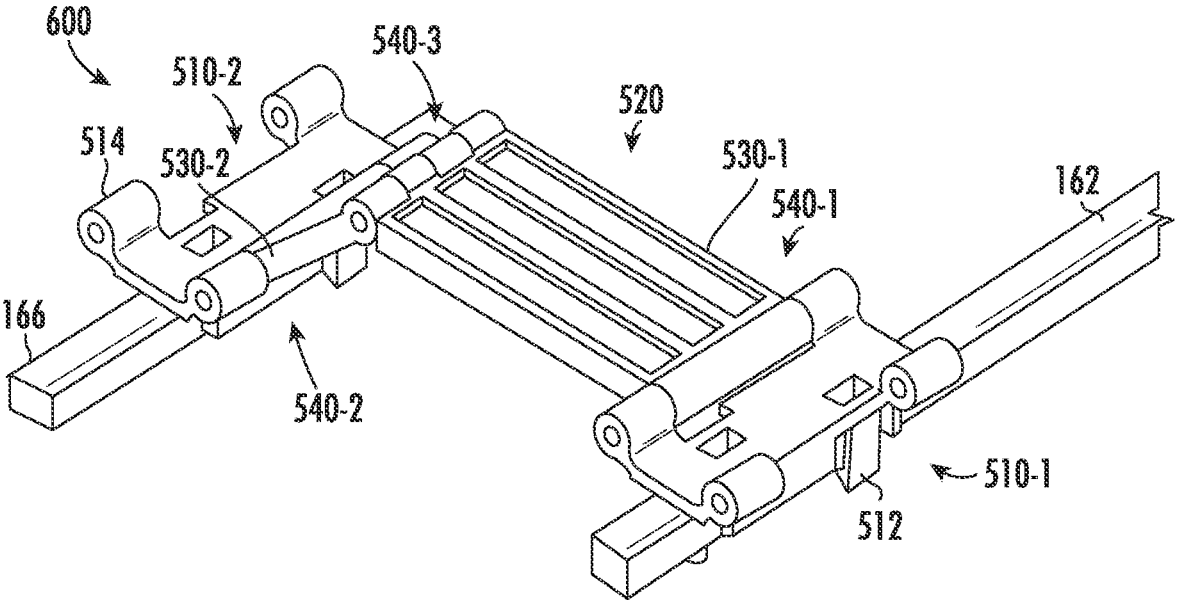
FIGS. 9A and 9B are a perspective view and a side view, respectively, of an adjustable RET linkage according to further embodiments of the present invention that includes connecting members that have links of different lengths.
Figure 9B:
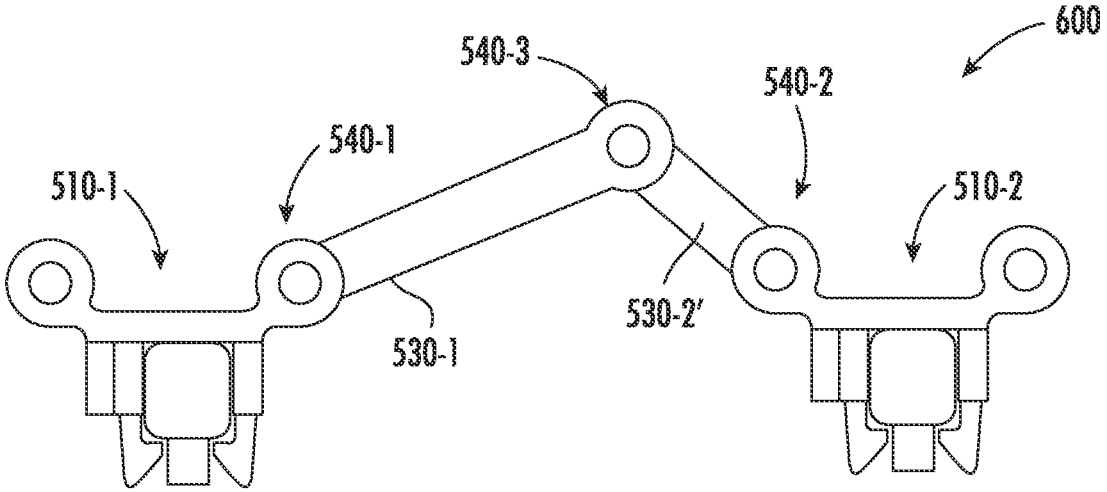

As can best be seen in FIG. 8D, in some cases the adjustable RET linkage 500 may be set so that the angle $\alpha$ is relatively small. As the angle $\alpha$ decreases, the overall height of the adjustable RET linkage 500 itself increases. This may be problematic in some antenna designs where the adjustable RET linkage 500 needs to be located a small distance from the backplane or some other element within the antenna. FIGS. 9A and 9B are a perspective view and a side view, respectively, of an adjustable RET linkage 600 according to further embodiments of the present invention that extends a smaller distance in the depth direction.

As shown in FIGS. 9A and 9B, according to further embodiments of the present invention, an adjustable RET linkage 600 is provided that may be identical to the adjustable RET linkage 500 except that the length of at least one of the third and fourth links 530-1, 530-2 of adjustable RET linkage 500 may be replaced with a different part in adjustable RET linkage 600. In particular, as shown in FIGS. 9A-9B, if one of the two identical links 530-1, 530-2 of adjustable RET linkage 500 is replaced with a shorter link 530-2', the overall height of the adjustable RET linkage 500 when configured to span a first distance in the width direction may be reduced. The use of the shorter link 530-2', however, may reduce the range of distances in the width and depth directions that can be spanned by the adjustable RET linkage 600.

Figure 10A:
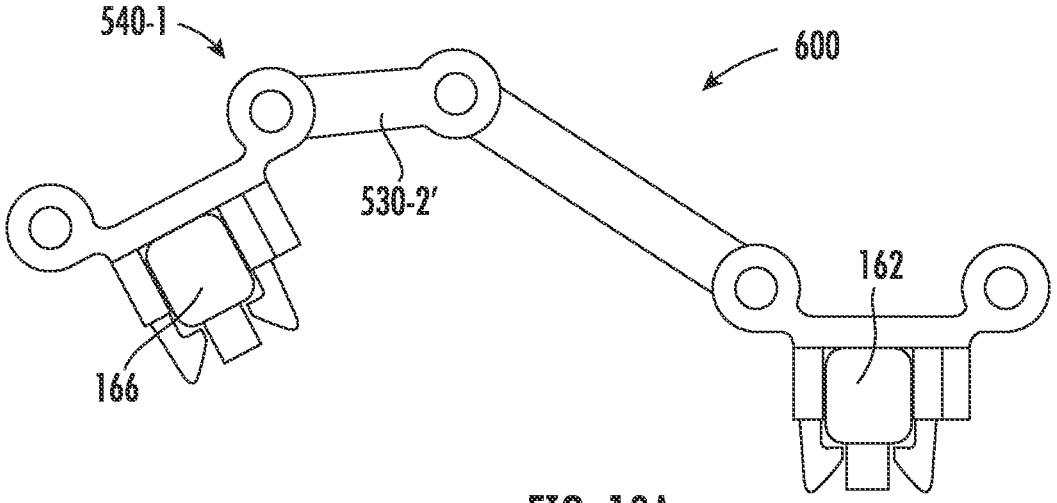
FIGS. 10A and 10B are side views illustrating how the adjustable RET linkages according to embodiments of the present invention may be configured to connect to elements of a mechanical linkage at different angles.
Figure 10B:
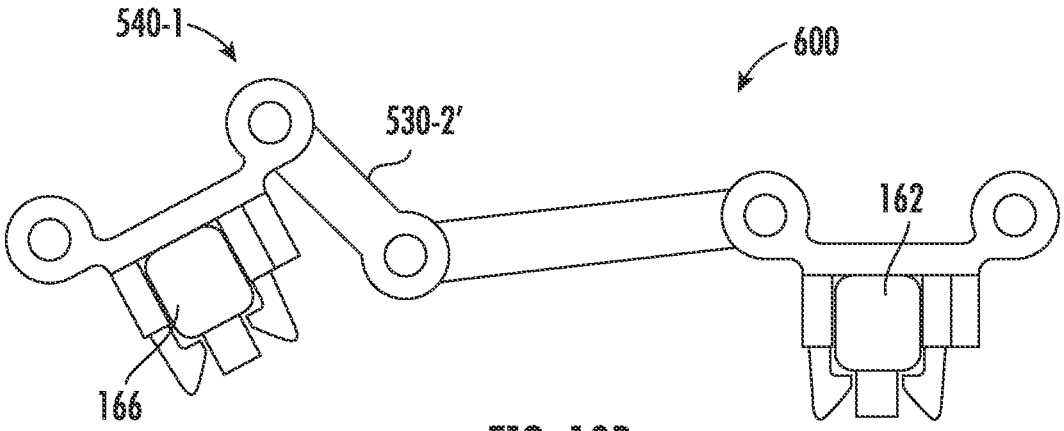

Referring next to FIG. 10A, it can be seen that the adjustable RET linkages according to embodiments of the present invention also provide flexibility with respect to the rotational angle of the first and second links. For example, in antennas that use multi-RET actuators that have a cylindrical design such as the multi-RET actuator 300 of FIG. 4, different RET rods 162, 166 in a mechanical linkage 160 may have different angular rotations. If a conventional mechanical linkage is used in such antennas, it typically is necessary to design the mechanical linkage to have RET linkages with connection members that extend at appropriate rotational angles to mate with the RET rods 162, 166. This further increases the number of conventional RET linkages that must be designed and maintained in inventory. In contrast, FIG. 10A illustrates how the first hinge on the adjustable RET linkage 600 of FIGS. 9A-9B may be rotated so that the first connection element 512 on the first link 510-1 may be positioned at a wide range of rotational angles for attachment to a RET rod 162 or other member of a mechanical linkage 160. While not shown in FIGS. 10A and 10B, the same flexibility is provided for the second link 510-2, and the adjustable RET linkage 500 of FIGS. 7-8D can similarly accommodate a wide range of angular rotations. FIG. 10B illustrates how the fourth link 530-2' may be positioned downwardly instead of upwardly in order to accommodate clearance requirements in the antenna.

Figure 11A:
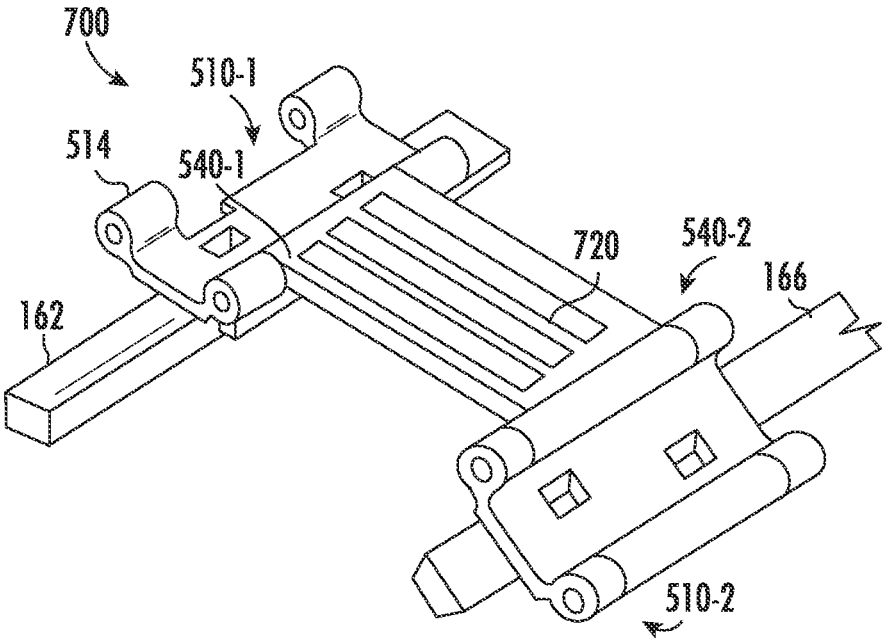
FIG. 11A is a perspective view illustrating an adjustable RET linkage according to further embodiments of the present invention that includes a single-piece connecting member.
Figure 11B:
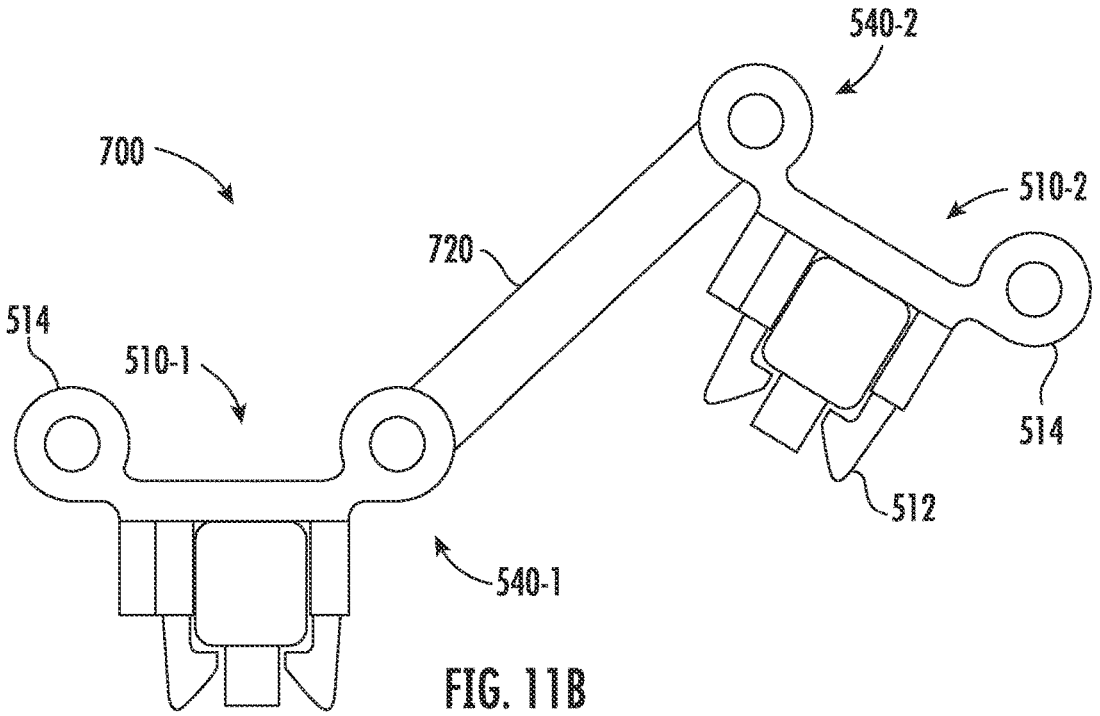
FIGS. 11B and 11C are side views of the adjustable RET linkage of FIG. 11A.
Figure 11C:
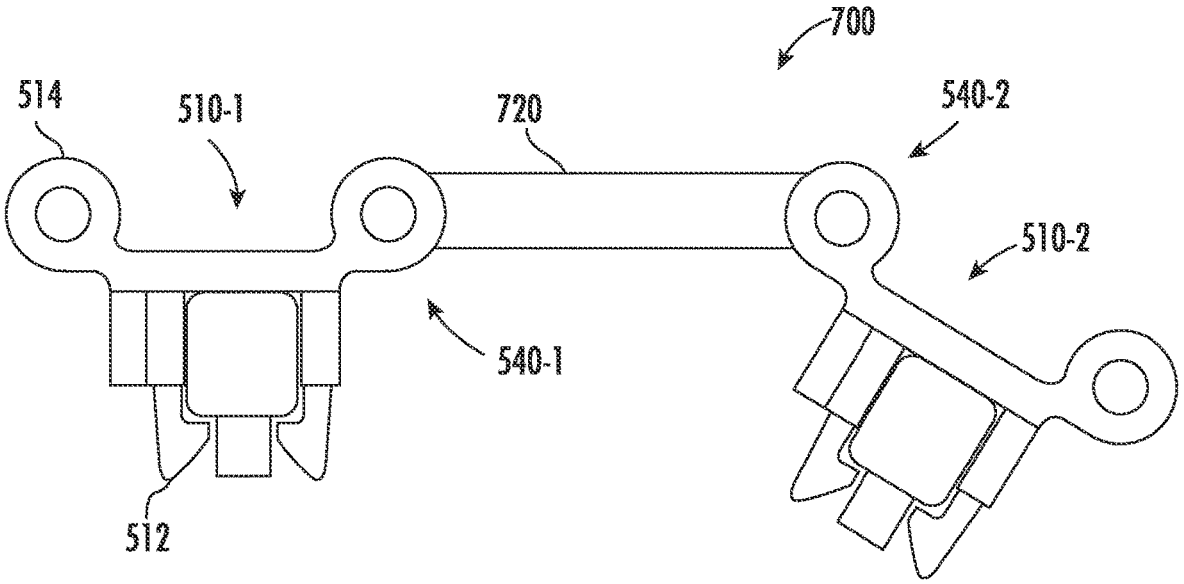

While the adjustable RET linkage 500 of FIG. 7 includes a two-piece connecting member 520, it will be appreciated that other designs are possible. For example, FIGS. 11A-11C illustrate an adjustable RET linkage 700 according to embodiments of the present invention that includes a single-piece connecting member 720. The adjustable RET linkage 700 may have less flexibility for spanning different spacing and angular offsets, but may be sufficient for many applications and may be simpler and cheaper to manufacture. In other embodiments (not shown), the connecting members may include more than two links.

Figure 12A:
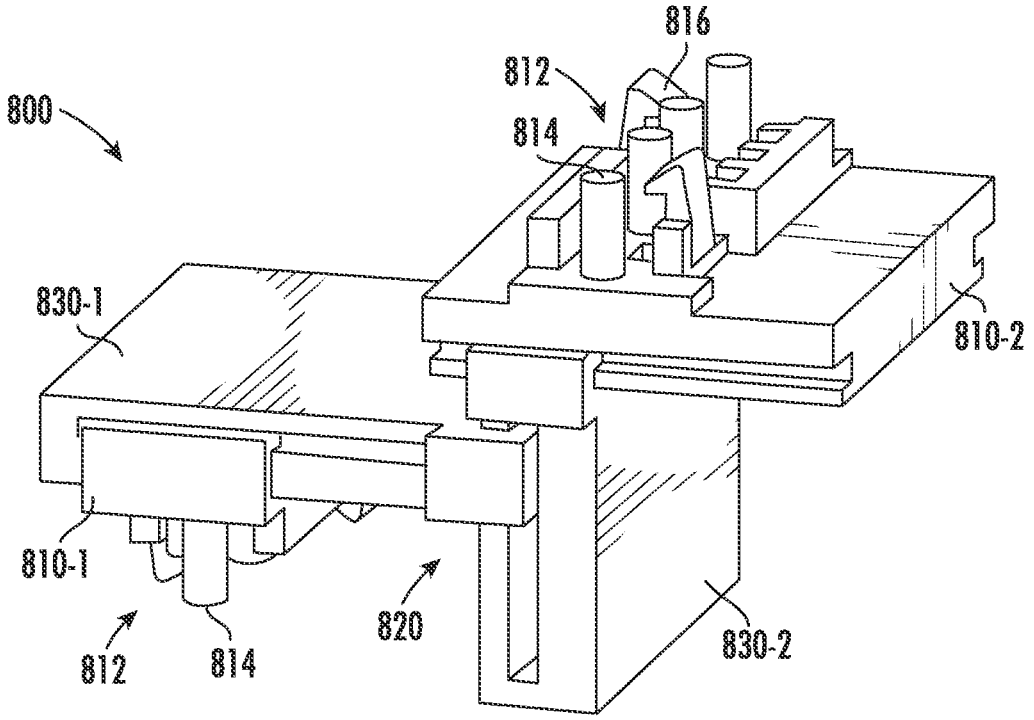
FIGS. 12A and 12B are perspective views of an adjustable RET linkage according to further embodiments of the present invention that includes links that slide relative to one another.
Figure 12B:
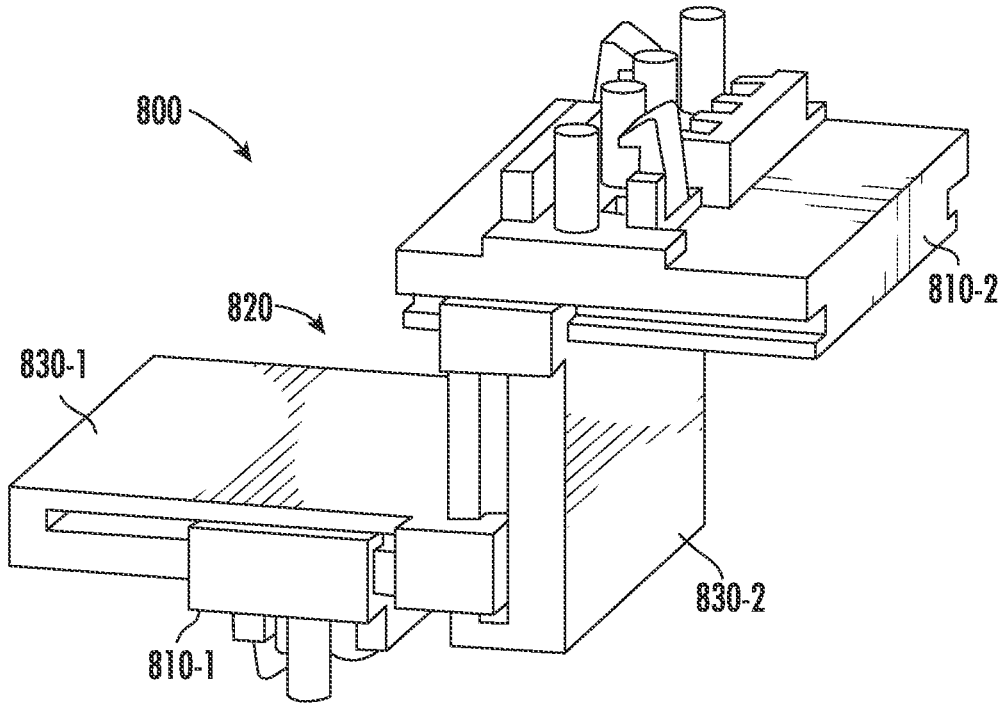

While the adjustable RET linkages 500, 600 and 700 each use hinges that provide pivotable connections between the different links, it will be appreciated that embodiments of the present invention are not limited thereto. For example, FIGS. 12A and 12B illustrate an adjustable RET linkage 800 according to further embodiments of the present invention that includes sliding links that may be used to accommodate different distances in the width and depth directions between RET rods or other elements of a mechanical linkage. As shown in FIGS. 12A-12B, the adjustable RET linkage 800 includes a first link 810-1 that has a first connection element 812 mounted thereon and a second link 810-2 that has a second connection element 812 mounted thereon. In the depicted embodiment, the connection elements 812 each comprise a series of posts 814 that are received within corresponding cylindrical holes in respective first and second RET rods 162, 166 (not shown in FIGS. 12A-12B) along with a pair of snap clips 816 that hold the respective RET rods 162, 166 in place with the posts 814 inserted into the holes in the RET rods 162, 166. It will be appreciated, however, that any of a wide variety of connection elements may be used.

The adjustable RET linkage 800 further includes a connecting member 820 that connects the first link 810-1 to the second link 810-2. In the embodiment of FIGS. 12A-12B, the connecting member 820 comprises third and fourth links 830-1, 830-2 that are slidably connected to each other. As can also be seen in FIGS. 12A and 12B, the first link 810-1 is slidably connected to the third link 830-1 and the second link 810-2 is slidably connected to the fourth link 830-2. Thus, the adjustable RET linkage 800 includes two links that can slide in the width direction plus a third link that can slide in the depth direction which allows the adjustable RET linkage 800 to span a wide range of distances in the width and depth directions. The adjustable RET linkage 800 also includes locking mechanisms (not shown) that can be used to lock each slidable link in place. Glue or epoxy are possible locking mechanisms, as are pin-and-slot or saw-tooth locking mechanisms as discussed above with reference to the adjustable RET linkage 500. The connections elements 812 may be any suitable mechanism for connecting the adjustable RET linkage 800 to a RET rod or other element of a mechanical linkage.

Figure 13A:
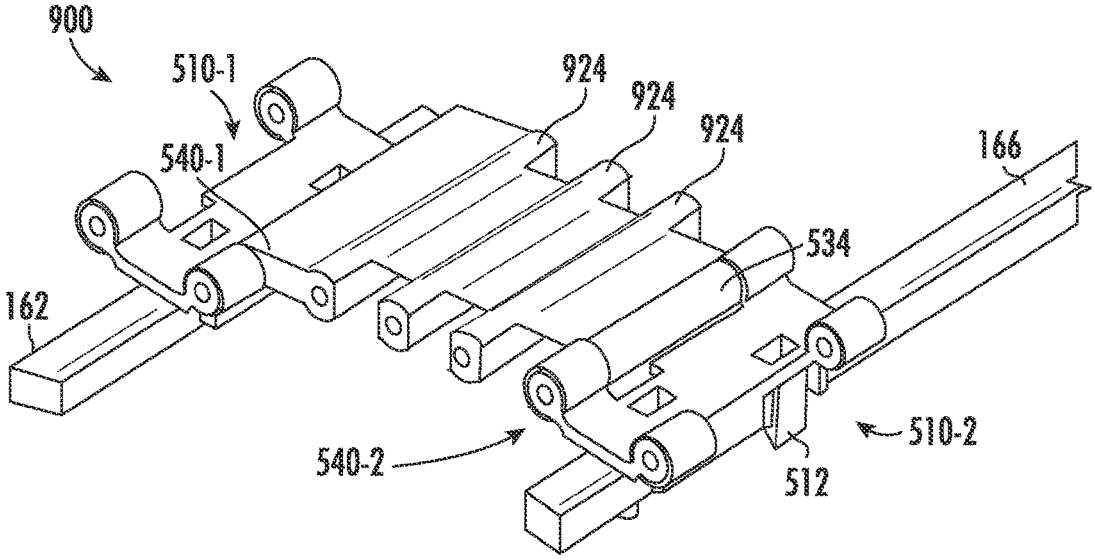
FIG. 13A is a perspective view of an adjustable RET linkage according to still further embodiments of the present invention.
Figure 13B:
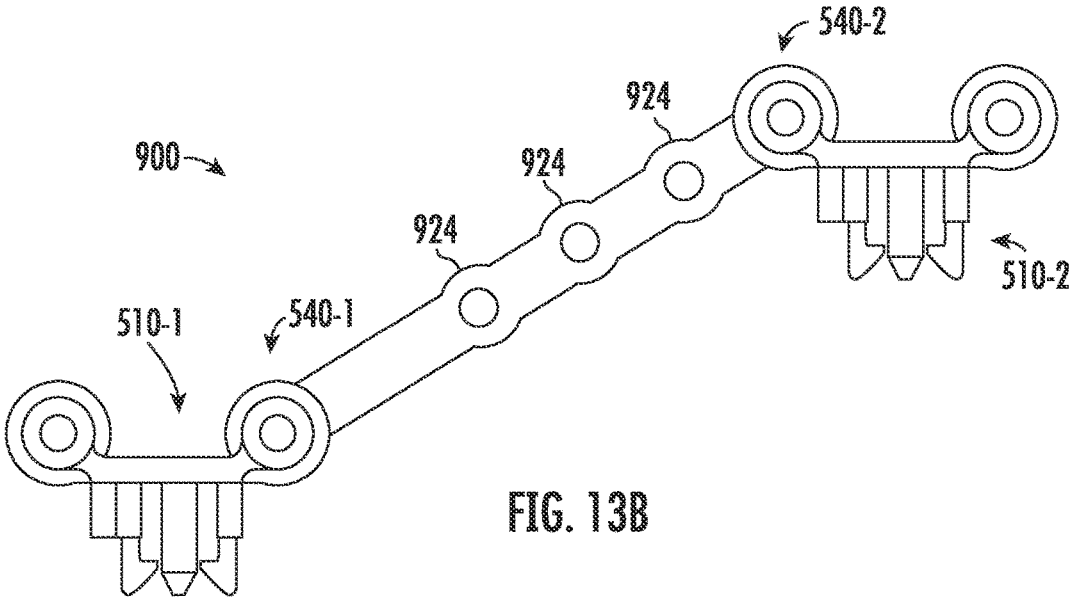
FIGS. 13B and 13C are side views of the adjustable RET linkage of FIG. 13A.
Figure 13C:
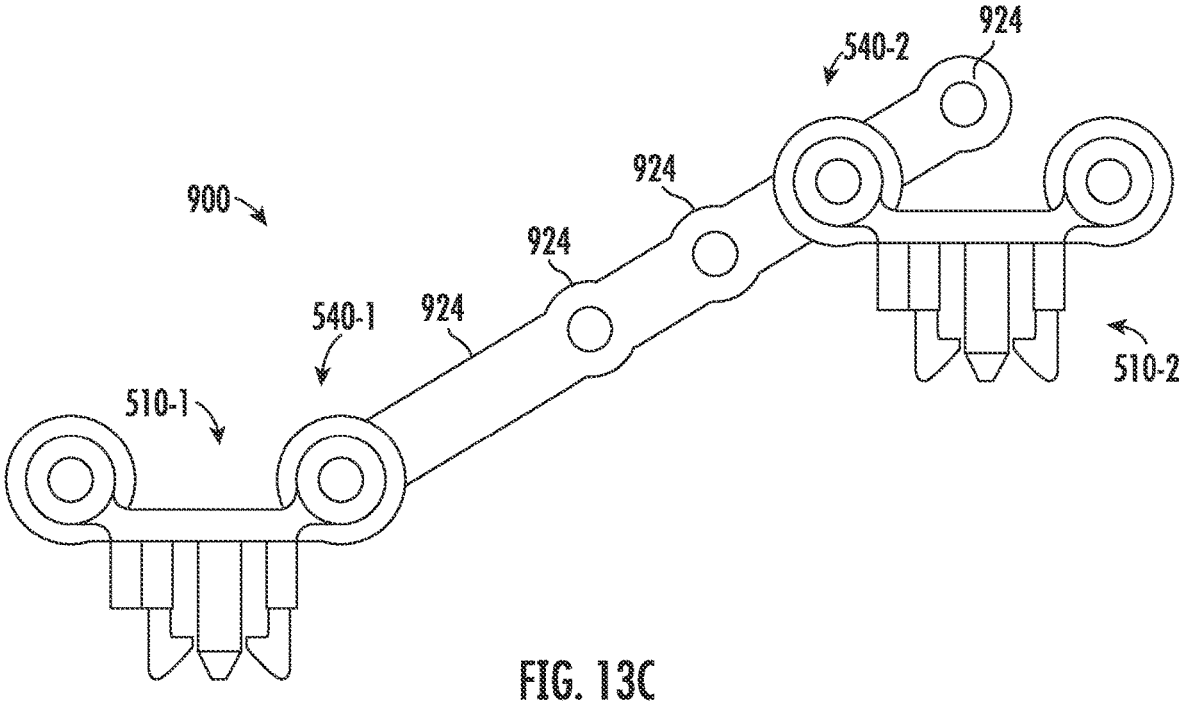

Pursuant to still further embodiments of the present invention, adjustable RET linkages are provided that have selectable positions so that the RET linkage may be pre-adjusted when assembled to have a desired span. FIG. 13A is a perspective view of one such adjustable RET linkage 900. FIGS. 13B and 13C are side views of the adjustable RET linkage 900.

As shown, the adjustable RET linkage 900 includes a single-link connecting member 920 that may be identical to the single link connecting member 720 of adjustable RET linkage 700, except that the connecting member 900 includes several additional annular receptacles 924 that extend through central portions of the connecting member 920. As shown in FIGS. 13B and 13C, the inclusion of the additional annular receptacles 924 allows the connecting member 920 to effectively be shortened or lengthened by selecting the annular receptacle that is used to form the second hinge 940-2.

Figure 15:
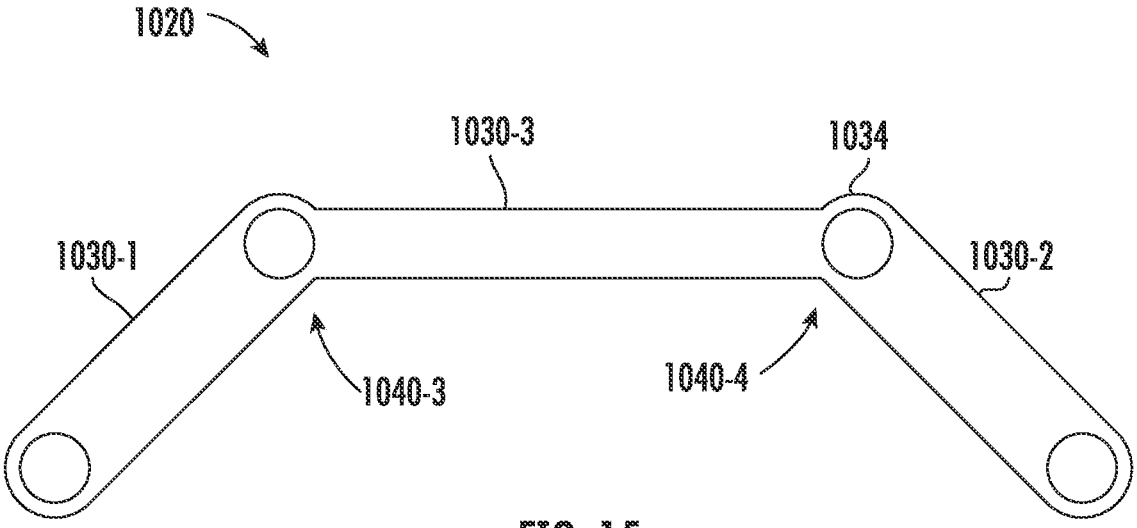
FIG. 15 is a schematic side view of a connecting member that may be used in adjustable RET linkages according to further embodiments of the present invention.

FIG. 15 is a schematic side view of a connecting member 1020 that may be used in adjustable RET linkages according to further embodiments of the present invention. As shown in FIG. 15, the connecting member 1020 includes three links 1030-1 through 1030-3 and two hinged connections 1040-1 and 1040-2. This allows the connecting member to have the shape of the conventional connecting member 460 illustrated in FIG. 6G.

It will also be appreciated that a base station antenna manufacturer may stock a small number of parts that can be used to form many different adjustable RET linkages that may be sufficient to support numerous lines of base station antennas. For example, a base station antenna manufacturer might stock each of the different pieces necessary to form the adjustable RET linkage 500 of FIG. 7, along with a few additional connecting member links that have different lengths (such as link 530-2' of FIGS. 9A, 9B), a few links having the design of connecting member 920 of FIGS. 13A-13C and a few links (of different lengths) having the design of link 1030-3 of FIG. 15. This small number of parts could be used to form adjustable RET linkages that could span almost any necessary distance in the width and depth directions by varying the links included in the RET linkage and the number of links/hinged connections used.

It will be appreciated that the above embodiments are intended as examples only, and that a wide variety of different embodiments fall within the scope of the present invention. It will also be appreciated that any of the above embodiments may be combined. For example, adjustable RET linkages may be provided that include both sliding links and pivoting links. It will also be appreciated that the connecting members may include more than two links, and that the three or more connecting links may be connected by hinged and/or sliding connections. Such a design may be particularly advantageous when the RET linkage needs to have a shape similar to that shown in FIG. 6G in order to avoid running into other structures within the antenna.

Pursuant to further embodiments of the present invention, adjustable RET linkages are provided that are formed from one or more standardized parts and one or more of a plurality of changeable parts. For example, two standardized parts and one of the plurality of changeable parts may be interconnected to form the adjustable RET linkage. These RET linkages are "adjustable" in the sense that different changeable parts may be interconnected with the standardized parts in order to adjust the distances spanned by the RET linkage in, for example, the width and/or depth directions of the base station antenna. The standardized parts may comprise parts that are configured for connection to a RET rod, while the changeable parts may comprise parts that are configured to span different distances in the width and/or depth directions. A changeable part may be used to connect two standardized parts together. The standardized and changeable parts may include mating features that allow each changeable part to readily be interconnected between a pair of standardized parts to form the adjustable RET linkage.

Figure 16A:
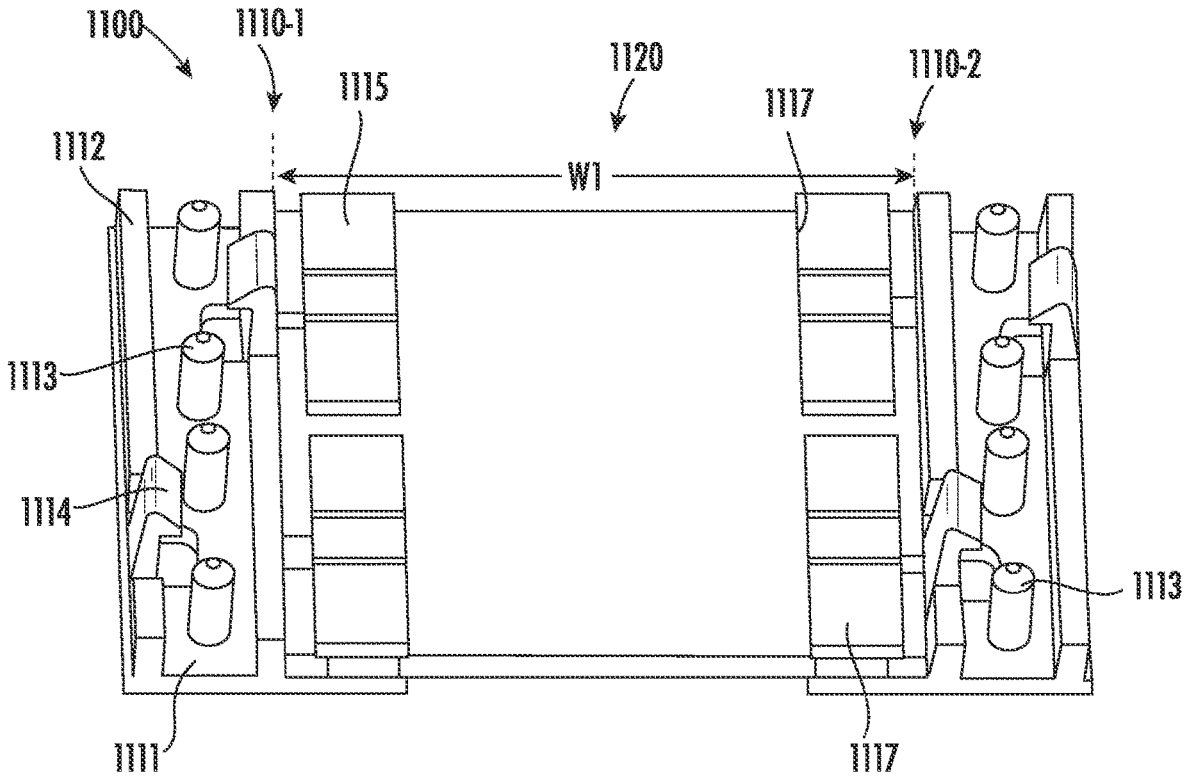
FIG. 16A is a perspective view of an adjustable RET linkage according to yet additional embodiments of the present invention.
Figure 16B:
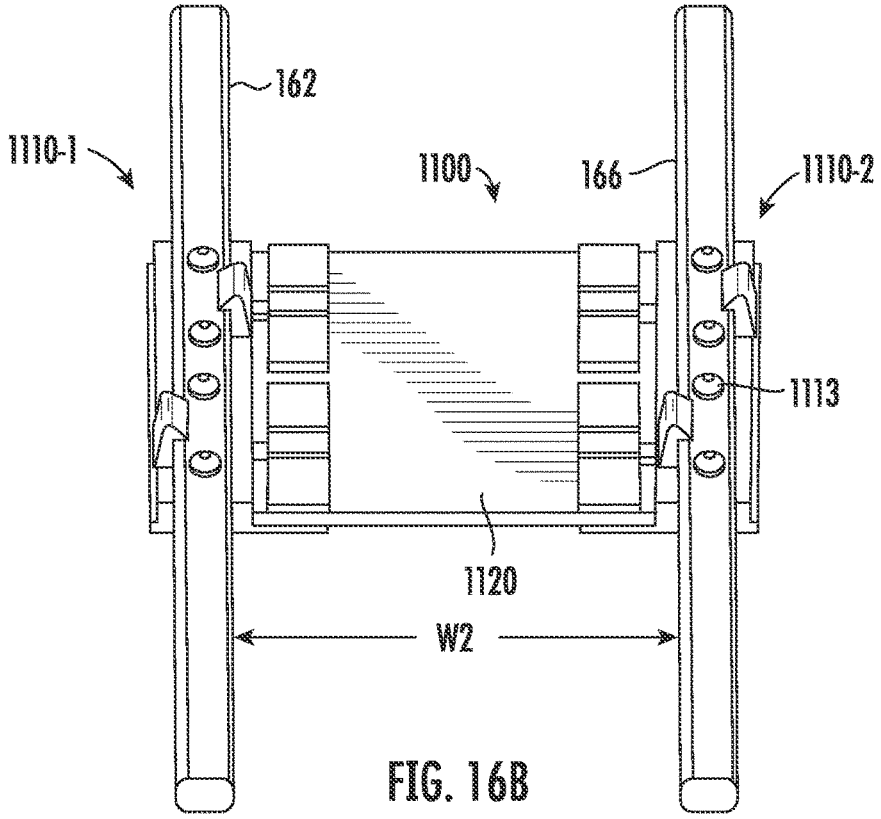
FIG. 16B is a perspective view illustrating how the adjustable RET linkage of FIG. 16A may be used to connect two RET rods.
Figure 17A:
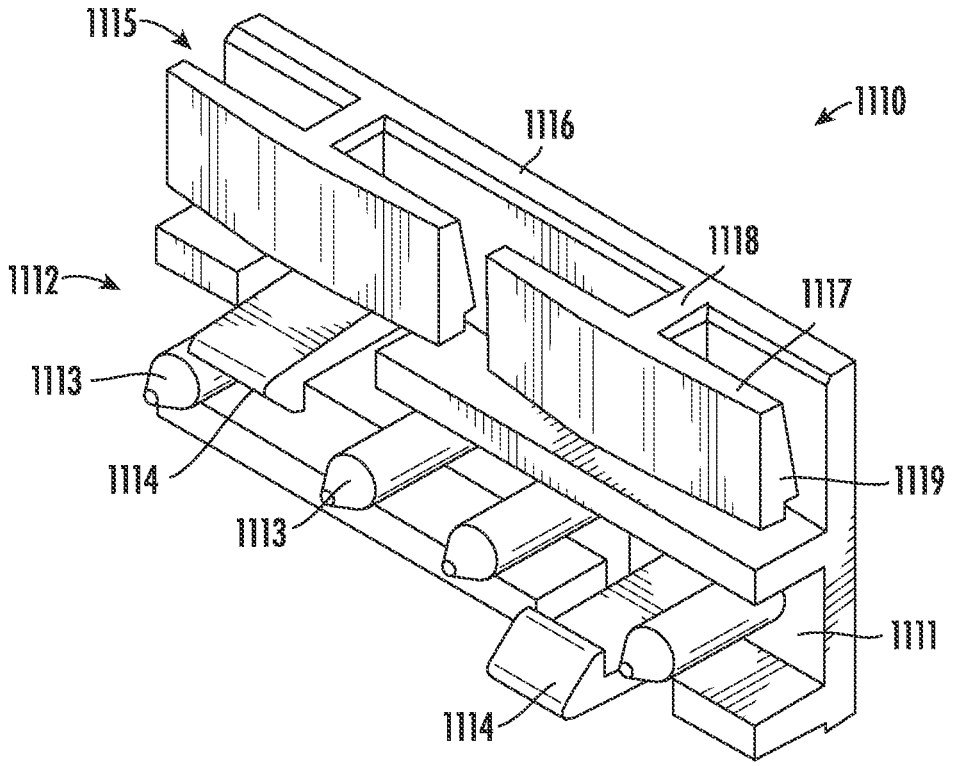
FIG. 17A is a perspective view of a standardized part of the adjustable RET linkage of FIG. 16.
Figure 17B:
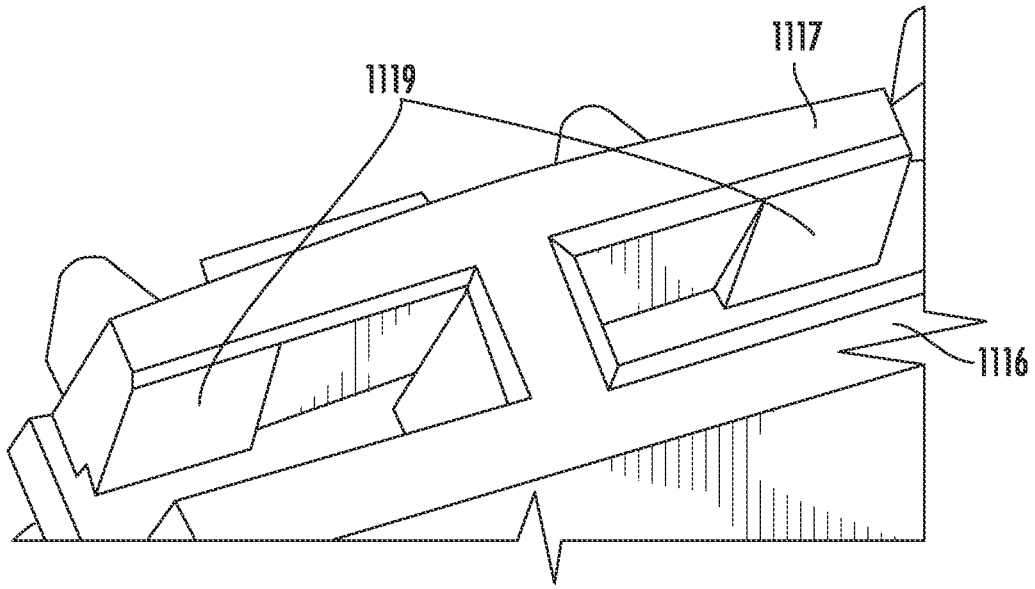
FIG. 17B is an enlarged perspective view of an end portion of the standardized part of FIG. 17A.
Figure 18A:
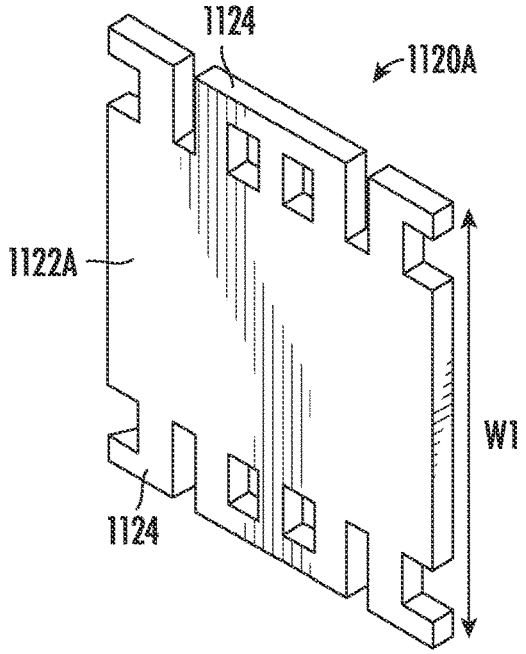
FIGS. 18A and 18B are perspective views of two example changeable parts that may be used to form the adjustable RET linkage of FIG. 16.
Figure 18B:
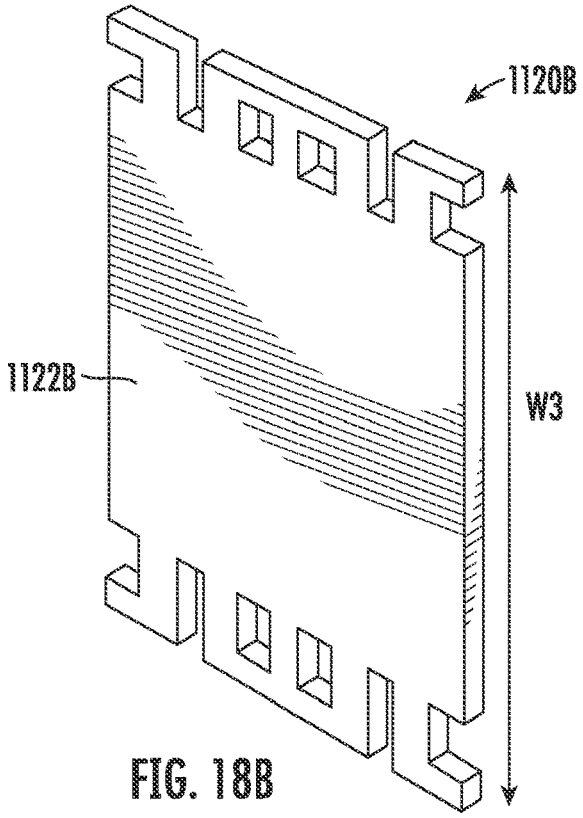
Figure 18C:
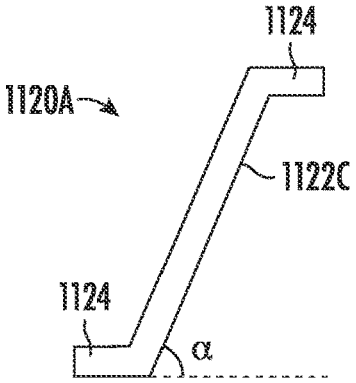
FIGS. 18C and 18D are side views of two additional example changeable parts that may be used to form the adjustable RET linkage of FIG. 16.
Figure 18D:
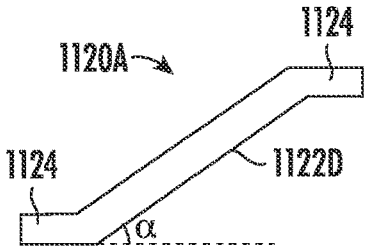

FIG. 16A is a perspective view of an example embodiment of an adjustable RET linkage 1100 according to embodiments of the present invention that is formed by interconnecting standardized and changeable parts. FIG. 16B is a perspective view illustrating how the adjustable RET linkage 1100 of FIG. 16A may be used to connect two RET rods. FIG. 17A is a perspective view of a standardized part that is included in the adjustable RET linkage 1100 of FIGS. 16A-16B. FIG. 17B is an enlarged perspective view of an end portion of the standardized part of FIG. 17A. FIGS. 18A and 18B are perspective views of two example changeable parts that may be used to form the adjustable RET linkage 1100 of FIGS. 16A-16B, while FIGS. 18C and 18D are side views of two additional example changeable parts that may be used to form the adjustable RET linkage 1100 of FIGS. 16A-16B.

As shown in FIGS. 16A-16B the adjustable RET linkage 1100 includes a first standardized part 1110-1 that connects to a first RET rod 162, a second standardized part 1110-2 that connects to a second RET rod 166, and a changeable connecting member 1120 that connects the first standardized part 1110-1 to the second standardized part 1110-2. In FIG. 16A, the adjustable RET linkage 1100 is depicted prior to attachment of the first and second standard parts 1110-1, 1110-2 to the respective first and second RET rods 162, 166 in order to better show the adjustable RET linkage 1100. The first and second standardized parts 1110-1, 1110-2 may be identical in some embodiments such that only a single standardized part design may be required in some cases. Since the first and second standardized parts 1110-1, 1110-2 have the same design in the embodiment of FIGS. 16A-16B, they will be described together below as a generic standardized part 1110 with reference to FIGS. 17A and 17B.

Referring to FIGS. 16A-16B and 17A, each standardized part 1110 includes a first connection element 1112 that is used to connect the standardized part 1110 to a RET rod and a second connection element 1115 that is used to connect the standardized part 1110 to a selected one of a plurality of changeable connecting members 1120. The first connection element 1112 comprises a recess 1111, a plurality of posts 1113 and a pair of snap clips 1114. The recess 1111 extends along the longitudinal direction of the RET rod to which the standardized part 1110 is to be attached, and may be sized so that the RET rod may be received within the recess 1111 and the walls of the recess 1111 may prevent relative lateral movement of the RET rod with respect to the standardized part 1110. The posts 1113 are mounted in the base of the recess 1111 and are sized to be received within corresponding holes in the RET rod. The posts 1113, when received within the corresponding holes in the RET rod, may prevent longitudinal movement of the standardized part 1110 relative to the RET rod received therein. The snap clips 1114 extend from the base of the recess 1111 and are designed to prevent vertical movement of the standardized part 1110 relative to the RET rod. The first connection element 1112 may allow the standardized part to be easily snapped onto a RET rod and, once in place, the standardized part 1110 will remain in a fixed position relative to the RET rod. While FIGS. 16A-16B and 17A illustrate one example first connection element 1112, it will be appreciated that any of a wide variety of first connection elements may be used such as, for example, any suitable combination of one or more posts, screws, hook and link fasteners, recesses, and the like. The connection elements 1112 may comprise male connection elements that mate with female connection elements on the RET rods, female connection elements that mate with male connection elements on the RET rods, a combination of male and female connection elements and/or connection elements that are neither male nor female in character.

The second connection element 1115 is used to connect the standardized part 1110 to a selected one of a plurality of changeable connecting members 1120. The second connection element 1115 comprises a bottom plate 1116, one or more top plates 1117, and one or more supports 1118 that connect the bottom plate 1116 and top plates 1117 and maintain the plates 1116, 1117 in a spaced-apart relationship. The space between the bottom plate 1116 and the top plate(s) 1117 may be sized to receive a third connection element 1124 (described below) of the selected one of the plurality of changeable connecting members 1120. The third connection element 1124 of the changeable connecting member 1120 may snap-in to the space between the bottom plate 1116 and the top plate(s) 1117.

As can be seen best in FIG. 17B, several detents 1119 may be provided, for example, on the bottom surfaces of one or more of the top plates 1117 and may prevent the changeable connecting member 1120 from disconnecting from the standardized part 1110 once the changeable connecting member 1120 is snapped into the second connection element 1115. The bottom and top plates 1116 and 1117 may prevent vertical movement (i.e., movement in the depth direction of the antenna) of the changeable connecting member 1120 relative to the standardized part 1110, and the support 1118 may prevent longitudinal movement of the changeable connecting member 1120 relative to the standardized part 1110. The detents 1119 may prevent lateral movement (i.e., movement in the width direction of the antenna) of the changeable connecting member 1120 relative to the standardized part 1110.

Referring to FIG. 18A, a changeable connecting member 1120A is illustrated that may connect the first standardized part 1110-1 to the second standardized part 1110-2. The changeable connecting member 1120A comprises a connecting piece 1122A that traverses a desired distance in the, for example, the width and depth directions. In the depicted embodiment, the connecting piece 1122A comprises a flat plate-like structure that extends for a desired distance W1 in the width direction and that does not extend (other than the thickness of the plate-like structure) in the depth direction. The connecting member 1120A further comprises a pair of third connection elements 1124 that are formed at opposed ends of the connecting piece 1122A. In the depicted embodiment, each third connection element 1124 comprises a series of slots and/or holes that are formed along the edges of the plate-like connecting piece 1122A. As discussed above, each third connection element 1124 mates with a second connection element 1115 of a respective standardized part 1110 in order to interconnect the changeable connecting member 1120A with a pair of standardized parts 1110 in order to form the adjustable RET linkage 1100.

As shown in FIGS. 16A-16B, when the adjustable RET linkage 1100 includes the particular changeable connecting member 1120A shown in FIG. 18A, the adjustable RET linkage 1100 may be used to connect two RET rods that are at the same depth from a reference plane within the base station antenna and that are spaced apart in the width direction by a distance W2 in the width direction which is slightly greater than the distance W1 in the width direction.

FIGS. 18B-18D illustrate three additional changeable connecting members 1120B, 1120C, 1120D that may be used in place of changeable connecting member 1120A so that the adjustable RET linkage 1100 may be adjusted to span different distances in the width and/or depth directions. For example, referring to FIG. 18B, it can be seen that the changeable connecting member 1120B is identical to the changeable connecting member 1120A except that the changeable connecting member 1120B has a connecting piece 1122B that extends for a distance W3 in the width direction that is greater than the distance W2 in the width direction. Thus, in order to connect two RET rods that are spaced farther apart in the width direction than the RET rods 162, 166 shown in FIG. 16B, changeable connecting member 1120B may be used to form the RET linkage 1100 instead of changeable connecting member 1120A.

The changeable connecting members 1120C and 1120D shown in FIGS. 18C and 18D, respectively, are designed to allow the adjustable RET linkage 1100 to connect RET rods that are offset in both the width and depth directions. The width of the connecting members 1120C, 1120D in the width direction and the angle $\alpha$ at which the connecting members 1120C, 1120D extend with respect to the depth direction may be set so that the adjustable RET linkage 1100 may span any desired distances in the width and depth directions.

Figure 19:
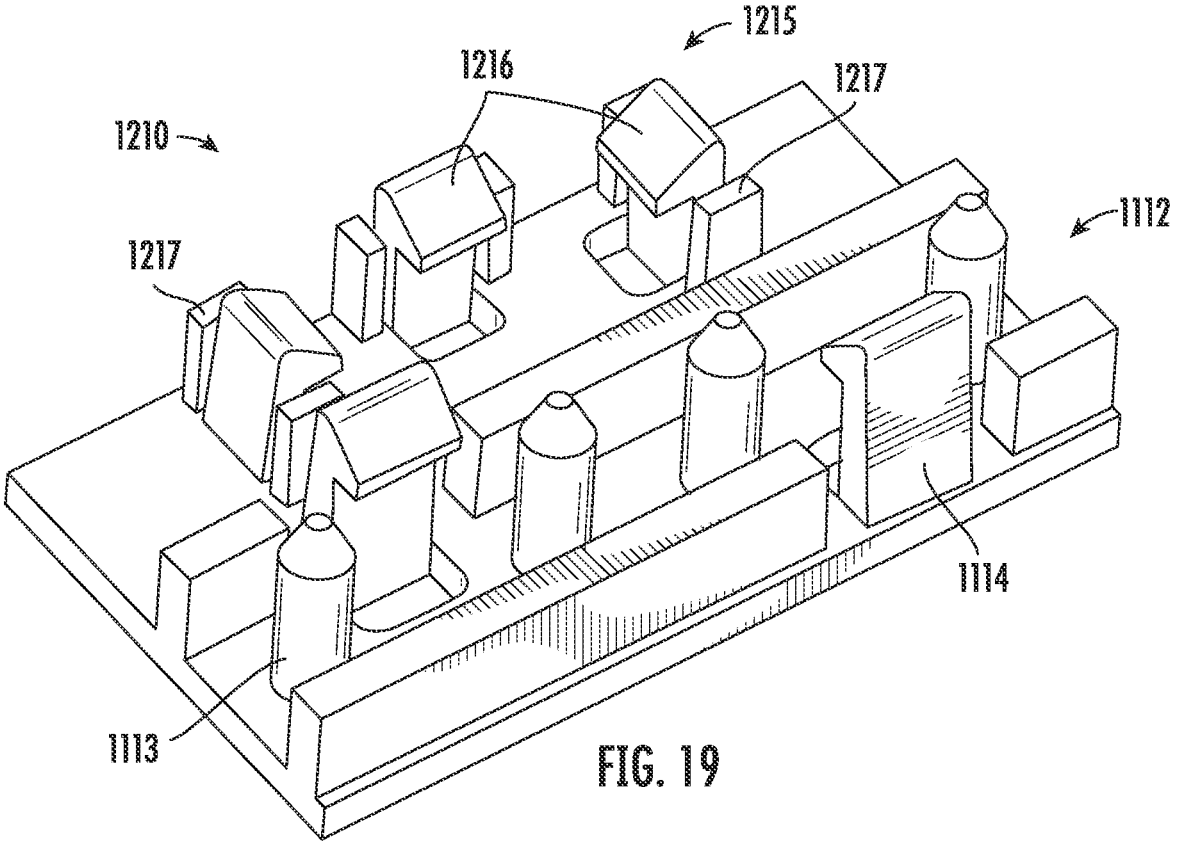
FIG. 19 is a perspective view of an alternative standardized part for the adjustable RET linkage of FIG. 16.

FIG. 19 is a perspective view of an alternative standardized part 1210 for the adjustable RET linkage of FIGS. 16A-16B. As can be seen by comparing FIG. 19 to FIG. 17A, the standardized part 1210 is similar to the standardized part 1110, and may include a first connection element 1112 that is used to connect the standardized part 1210 to a RET rod and a second connection element 1215 that is used to connect the standardized part 1210 to a selected one of a plurality of changeable connecting members 1220. The first connection element 1112 is identical to the first connection element 1112 of adjustable RET linkage 1100, and hence further description thereof will be omitted. The second connection element 1215 comprises three snap clips 1216 as well as six strength members 1217. Two strength members 1217 are positioned on opposed sides of each of the three snap clips 1216.

While not shown in the drawings, two of the standardized parts 1210 of FIG. 19 may be used in conjunction with a plurality of changeable connecting members (not shown) to form an adjustable RET linkage according to further embodiments of the present invention. The two standardized parts 1210 may connect to a respective pair of RET rods and opposed ends of a selected one of the plurality of changeable connecting members that is sized to span the gap between the two standardized parts 1210 may be connected to the respective standardized parts 1210 by inserting the opposed ends of the selected changeable connecting member into the second connection elements 1215 of the standardized parts 1210. The opposed ends of the changeable connecting member (not shown) may include slots, openings or the like that are configured to receive the snap clips 1216 so that the changeable connecting member will be firmly connected to each standardized part 1210. The three snap clips 1216 are arranged in to prevent the longitudinal and/or lateral movement of the changeable connecting member relative to the standardized part 1210. The projections on the distal ends of the snap clips 1216 may prevent vertical movement of the changeable connecting member relative to the standardized part 1210.

Figure 20:
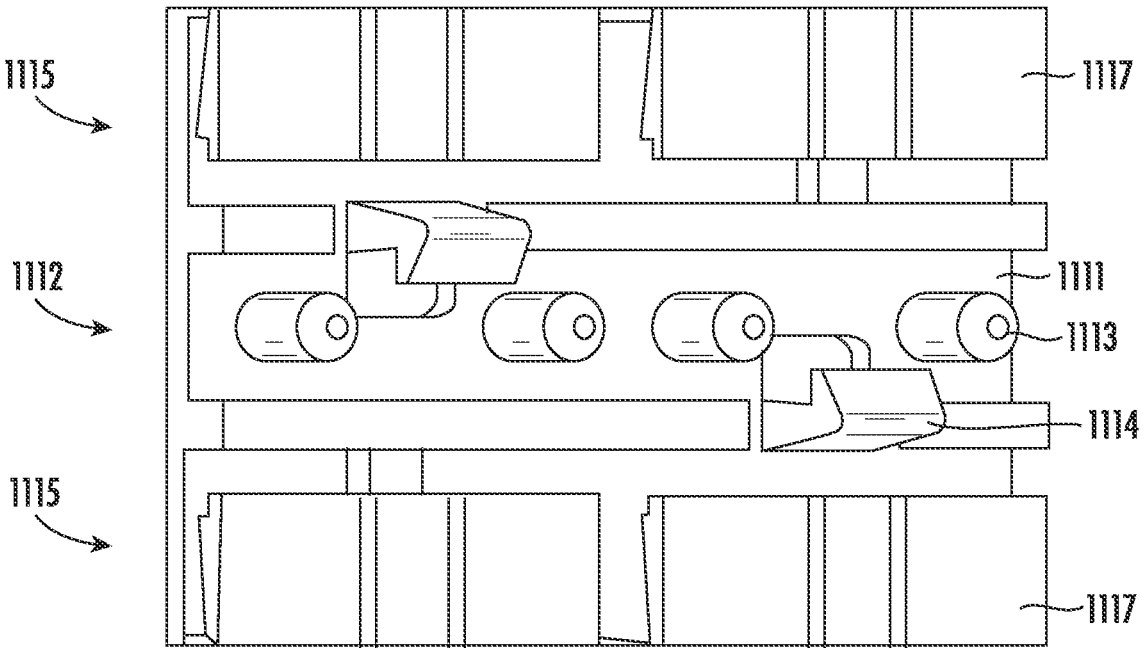
FIG. 20 is a perspective view of a standardized part of an adjustable RET linkage according to embodiments of the present invention that may be used to connect more than two RET rods together.
Figure 21A:
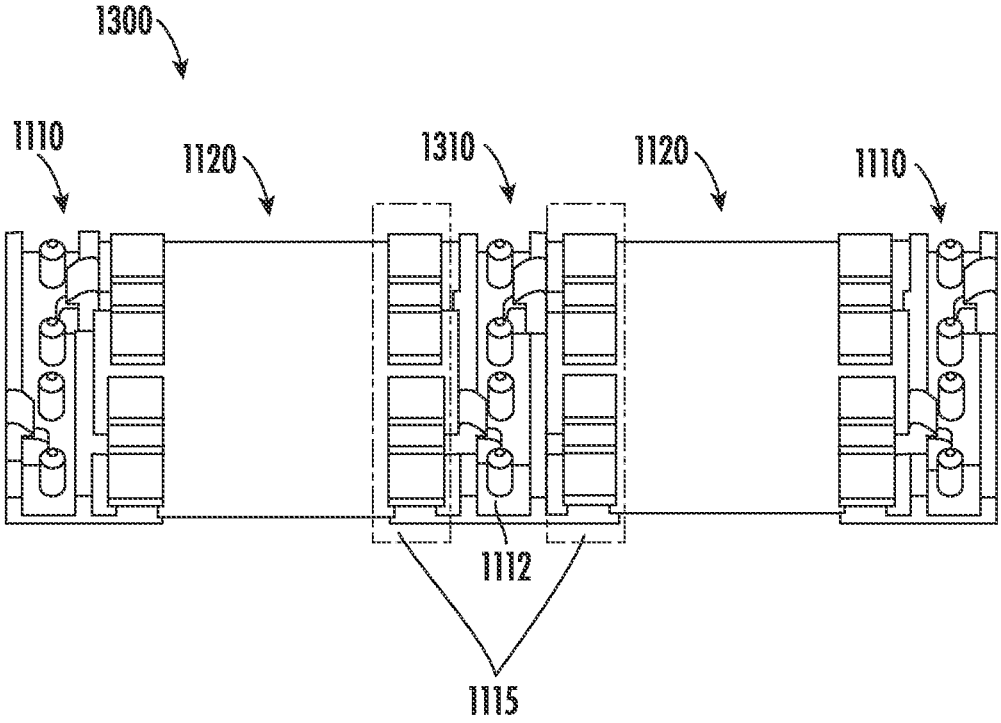
FIG. 21A is a perspective view of an adjustable RET linkage according to embodiments of the present invention that includes the standardized part of FIG. 20.
Figure 21B:
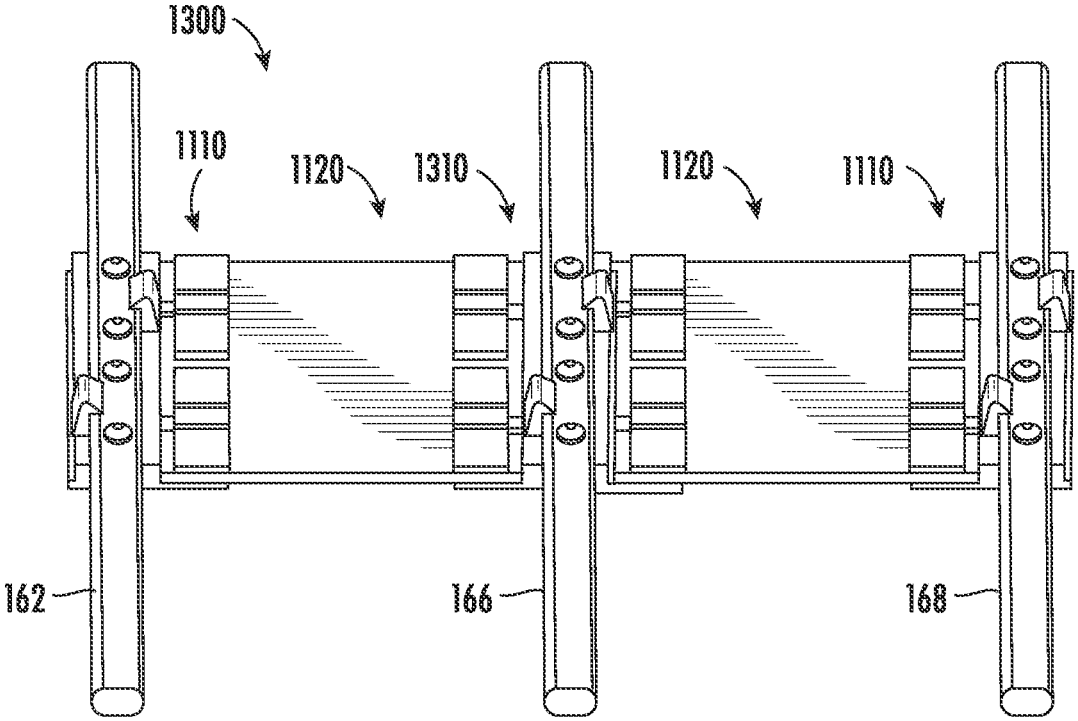
FIG. 21B is a perspective view illustrating how the adjustable RET linkage of FIG. 21A may be used to connect two RET rods

FIG. 20 is a perspective view of a standardized part 1310 that has two second connection elements and a first connection element. The standardized part 1310 may be used in an adjustable RET linkage according to further embodiments of the present invention that connects more than two RET rods together. FIG. 21A is a perspective view of an adjustable RET linkage 1300 according to embodiments of the present invention that includes the standardized part 1310 of FIG. 20. FIG. 21B is a perspective view illustrating how the adjustable RET linkage 1300 of FIG. 21A may be used to connect three RET rods together.

As shown in FIG. 20, the standardized part 1310 is similar to the standardized part 1110 discussed above with reference to FIGS. 17A-17B, except that the standardized part 1310 includes two second connection elements 1115 that are positioned on each side of a first connection element 1112. This arrangement allows the standardize part 1310 to connect to two different changeable connecting members 1120, which may each have the same design or which may have different designs.

As shown in FIGS. 21A and 21B, the standardized part 1310 may be used in an adjustable RET linkage 1300 that includes, for example, two standardized parts 1110, two changeable connecting members 1120, and a standardized part 1310. Each standardized part 1110, 1310 may be mounted on a respective RET rod (see FIG. 21B), and hence the adjustable RET linkage 1300 may be used to connect three RET rods 162, 166, 168 together. While not shown in the drawings, it will readily be appreciated that additional standardized parts 1310 and changeable connecting members 1120 may be added so that the adjustable RET linkage 1300 may be used to connect more than three RET rods. As the standardized parts 1110 and the various changeable connecting members 1120 have been discussed in detail above, further description thereof will be omitted here.

The standardized parts (e.g., 1110, 1210, 1310) of the adjustable RET linkages according to embodiments of the present invention that exhibit adjustability through the selection of one of a plurality of changeable parts. The standardized parts may be molded plastic parts in some embodiments. Since only one or a few different standardized part designs may be required, the standardized parts may be manufactured using one or a small number of molds and hence may be fabricated in large numbers at very low cost. In some embodiments, the changeable connecting members may be formed of sheet metal by stamping and (when necessary) bending processes. This may allow a large number of different changeable connecting member designs to be fabricated quickly and at relatively low cost. In other embodiments, the changeable connecting members may be formed of plastic or other materials. Thus, by forming the adjustable RET linkages using both standardized parts and a selected one of a plurality of changeable connecting member designs, adjustable RET linkages may be provided that are inexpensive to manufacture and easy to assemble using, for example, snap-in or snap-fit connections.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the terms "attached", "connected", "interconnected", "contacting", "mounted" and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

That which is claimed is:

1. A base station antenna, comprising:

a remote electronic tilt ("RET") actuator;

a phase shifter having a moveable element; and a mechanical linkage extending between the RET actuator and the phase shifter, the mechanical linkage including a first RET rod, a second RET rod and an adjustable RET linkage that connects the first RET rod to the second RET rod, the adjustable RET linkage including a first connection element that connects to the first RET rod and a second connection element that connects to the second RET rod, wherein the adjustable RET linkage is configured so that a distance between the first connection element and the second connection element is adjustable, wherein the adjustable RET linkage comprises a multi-part RET linkage that includes a first piece that includes the first connection element, a second piece that includes the second connection element, and a third piece that connects the first piece to the second piece, wherein dimensions of the third piece are selected based at least in part on a distance between the first RET rod and the second RET rod in at least one of a width direction and a depth direction of the base station antenna.

2. The base station antenna of claim 1, wherein the first and second pieces are plastic pieces and the third piece is a metal piece or a plastic piece.

3. The base station antenna of claim 1, wherein the third piece is formed of stamped sheet metal.

4. The base station antenna of claim 1, wherein the third piece has mating features on opposed ends thereof that are configured to mate with corresponding mating features on the respective first and second pieces.

5. The base station antenna of claim 1, wherein the third piece is connected to the first piece by a snap-fit or snap-in connection.

6. The base station antenna of claim 1, wherein the first and second pieces have the same configuration and size.

7. The base station antenna of claim 1, wherein the first and second pieces have a different configuration and/or size.

8. A base station antenna, comprising:

a remote electronic tilt ("RET") actuator;

a phase shifter having a moveable element; and a mechanical linkage extending between the RET actuator and the phase shifter, the mechanical linkage including a first RET rod, a second RET rod and a multi-piece RET linkage that includes a first piece that is mounted on the first RET rod, a second piece that is mounted on the second RET rod, and a third piece that is directly connected to the first piece, wherein the dimensions of the third piece are selected based at least in part on a distance between the first RET rod and the second RET rod in at least one of a width direction and a depth direction of the base station antenna.

9. The base station antenna of claim 8, wherein the third piece is also directly connected to the second piece at a location that is spaced apart from the first piece.

10. The base station antenna of claim 8, wherein the third piece is indirectly connected to the second piece.

11. The base station antenna of claim 8, wherein the first and second pieces are plastic pieces and the third piece is a metal piece.

12. The base station antenna of claim 8, wherein the third piece is formed of stamped sheet metal.

13. The base station antenna of claim 12, wherein the third piece has mating features on opposed ends thereof that are configured to mate with corresponding mating features on the respective first and second pieces.

14. The base station antenna of claim 13, wherein the third piece is connected to the first piece by a snap-fit or snap-in connection.

15. The base station antenna of claim 8, wherein the first and second pieces are plastic pieces.

16. The base station antenna of claim 15, wherein the third piece is also a plastic piece.

17. A base station antenna, comprising:

a remote electronic tilt ("RET") actuator;

a phase shifter having a moveable element; and a mechanical linkage extending between the RET actuator and the phase shifter, the mechanical linkage including a first RET rod, a second RET rod and a multi-piece RET linkage that includes a first piece that is mounted on the first RET rod, and a second piece that is mounted on the second RET rod, wherein the mechanical linkage further comprises a connecting member that couples to the first and second pieces and is provided in a plurality of different width and/or depth dimensions to accommodate different distances between the first RET rod and the second RET rod for different base station antenna configurations, wherein the connecting member is configured to directly connect to the first piece.

18. The base station antenna of claim 17, wherein the connecting member has mating features on opposed ends thereof that are configured to mate with corresponding mating features on the respective first and second pieces.

19. The base station antenna of claim 17, wherein the connecting member is connected to the first piece by a snap-fit or snap-in connection.

20. The base station antenna of claim 17, wherein the first and second pieces are plastic pieces.

* * * * *